US009233530B2

(12) United States Patent
Ishiwata et al.

(10) Patent No.: US 9,233,530 B2
(45) Date of Patent: Jan. 12, 2016

(54) DRIVE CONTROL METHOD AND DRIVE CONTROL APPARATUS FOR PRINTING PRESS

(75) Inventors: Masahiro Ishiwata, Tokyo (JP); Shigeru Yanagawa, Tokyo (JP); Kouichi Katsumata, Tokyo (JP); Mikio Matsumoto, Tokyo (JP); Tatsuhiko Yokochi, Tokyo (JP); Hiromitsu Numauchi, Tsukuba (JP); Kenji Hayashi, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 1034 days.

(21) Appl. No.: 13/022,240

(22) Filed: Feb. 7, 2011

(65) Prior Publication Data

US 2011/0192298 A1 Aug. 11, 2011

(30) Foreign Application Priority Data

Feb. 8, 2010 (JP) ..... 2010-025197
Feb. 8, 2010 (JP) ..... 2010-025198

(51) Int. Cl.

| | |
|---|---|
| ***B41F 9/10*** | (2006.01) |
| ***B41F 11/02*** | (2006.01) |
| ***B41F 13/00*** | (2006.01) |
| ***B41F 11/00*** | (2006.01) |
| ***B41F 13/004*** | (2006.01) |

(Continued)

(52) U.S. Cl.

CPC ..... *B41F 11/02* (2013.01); *B41F 11/00* (2013.01); *B41F 13/00* (2013.01); *B41F 13/008* (2013.01); *B41F 13/0045* (2013.01); *B41F 33/0009* (2013.01); *B41P 2213/256* (2013.01)

(58) Field of Classification Search

USPC ..... 101/167, 170

See application file for complete search history.

(56) References Cited

U.S. PATENT DOCUMENTS 3,703,863 A * 11/1972 Giuiuzza ..... 101/183
4,584,939 A * 4/1986 Giori ..... 101/152

(Continued)

FOREIGN PATENT DOCUMENTS

EP 0786341 * 7/1997 ..... B41F 33/00
EP 1 717 031 A2 11/2006
JP 2006-305903 11/2006

OTHER PUBLICATIONS

Extended European Search Report dated May 20, 2011.

*Primary Examiner* — Judy Nguyen
*Assistant Examiner* — Marissa Ferguson Samreth
(74) *Attorney, Agent, or Firm* — Birch, Stewart, Kolasch & Birch, LLP

(57) ABSTRACT

According to a drive control method and apparatus, an offset printing section and an intaglio printing section are connected together by a gear train. Separately from an offset printing section prime motor for driving an entire sheet-fed printing press, an intaglio printing section auxiliary motor is provided in the intaglio printing section where load is heaviest and load variations are great. By so doing, the entire sheet-fed printing press is driven by the offset printing section prime motor and the intaglio printing section auxiliary motor. Moreover, the electric current value (driving torque value) of the intaglio printing section auxiliary motor is controlled in accordance with an electric current value (torque value) for driving the offset printing section prime motor, the torque distribution rate of the intaglio printing section auxiliary motor, and the rated electric current value of the intaglio printing section auxiliary motor.

10 Claims, 31 Drawing Sheets

(51) Int. Cl.
*B41F 13/008* (2006.01)
*B41F 33/00* (2006.01)

(56) References Cited

U.S. PATENT DOCUMENTS 5,042,378 A * 8/1991 Germann ..... 101/152
5,983,793 A * 11/1999 Volz et al. ..... 101/216
6,546,865 B2 * 4/2003 Fischer et al. ..... 101/350.3
2002/0005127 A1 1/2002 Fujiwara et al.
2003/0019375 A1 * 1/2003 Grutzmacher et al. ..... 101/216
2003/0106444 A1 * 6/2003 Berti et al. ..... 101/211
2006/0260485 A1 * 11/2006 Ohsawa ..... 101/230

* cited by examiner

DRIVE CONTROL METHOD AND DRIVE CONTROL APPARATUS FOR PRINTING PRESS

BACKGROUND OF THE INVENTION

1. Field of the Invention

The present invention relates to a drive control method and a drive control apparatus for a printing press such as a sheet-fed printing press.

2. Description of the Related Art

A printing press, such as a sheet-fed printing press, especially, a securities printing press, has hitherto been equipped with an offset printing section and an intaglio printing section in order to carry out offset printing and intaglio printing at a stroke, and has driven these printing sections by a single prime motor.

Thus, a high load has been imposed on the prime motor, and the use of the prime motor with great capacity has been necessitated. As a result, the use of an expensive motor has been needed, and the rigidity of a drive system has been required, causing further upsizing. Thus, the problems have arisen that a motor with even greater capacity has to be used, and a high speed operation cannot be performed.

Moreover, a printing pressure between an intaglio cylinder and an impression cylinder of the intaglio printing section is so high that a load under the printing pressure exerted by the surfaces of both cylinders in contact is heavy. Thus, the use of the motor with even greater capacity has been necessitated.

Furthermore, a wiping roll of the intaglio printing section thermally expands over time, increasing a contact pressure on the intaglio cylinder. To deal with an expected increase in the load, the use of the motor with even greater capacity has been required.

CITATION LIST

Patent Literature

[Patent Document 1] JP-A-2006-305903

SUMMARY OF INVENTION

Technical Problem

Under these circumstances, it is conceivable to drive an offset printing section (a group of processing units on the upstream side in a sheet flow direction) and an intaglio printing section (a group of processing units on the downstream side in the sheet flow direction) by separate prime motors, and control the speeds and the phases of the two prime motors to be synchronized, as disclosed in Patent Document 1.

However, it is not easy to achieve such synchronous control, because the following various problems occur: There are great variations in load between a state where the printing pressure between the intaglio cylinder and the impression cylinder of the intaglio printing section is so high that the printing pressure is exerted by the surfaces of both cylinders in contact, and a state where the notches of both cylinders oppose and no printing pressure is exerted. As a result, rotational speed variations occur owing to a backlash within a gear train between the prime motor of the intaglio printing section and the first transfer cylinder of the intaglio printing section. In this case, when a sheet is transferred from the last transfer cylinder of the offset printing section to the first transfer cylinder of the intaglio printing section, the sheet cannot be transferred at the exact position, thereby arousing a printing trouble. Even greater variations in the rotational speed cause a gripping error for the sheet, or a bend at the edge of the sheet, thus taking plenty of time until a normal operation is resumed.

It is an object of the present invention, therefore, to downsize the drive system by rendering the capacity of the prime motor small, thereby achieving cost reduction and high speed printing, and permit independent driving in each printing section, if necessary.

This object is attained by the following measures: The offset printing section and the intaglio printing section are connected by a gear train. Separately from the prime motor which drives the entire printing press, an auxiliary motor is provided in the intaglio printing section bearing the heaviest load and involving great load variations. The entire printing press is driven by the prime motor and the auxiliary motor, and the driving torque of the auxiliary motor is obtained from the driving torque of the prime motor.

Moreover, a clutch is provided between the last transfer cylinder of the offset printing section and the first transfer cylinder of the intaglio printing section, and the last transfer cylinder of the offset printing section is provided with a gripper release mechanism. By disengaging the clutch, the offset printing section and the intaglio printing section can be driven independently; the offset printing section is driven by the prime motor, and the intaglio printing section is driven by the auxiliary motor. By so doing, preparations for printing and subsequent settling operations can be performed at the same time.

Solution to Problem

An aspect of the present invention for solving the above problems is a drive control method for a printing press which includes an offset printing section for doing offset printing, an intaglio printing section for doing intaglio printing, a gear train for drivingly connecting the offset printing section and the intaglio printing section, and a prime motor for driving the offset printing section and the intaglio printing section, the drive control method comprising:

providing an auxiliary motor in the intaglio printing section; and driving the auxiliary motor in accordance with a torque value for driving the prime motor.

The drive control method may further comprise further providing a wiping roll motor for driving a wiping roll of the intaglio printing section; and driving the auxiliary motor in accordance with the torque value for driving the prime motor, and a torque value for driving the wiping roll motor.

The drive control method may further comprise obtaining a driving torque value of the auxiliary motor from a torque for driving the prime motor, a torque distribution rate of the auxiliary motor, and a rated electric current value of the auxiliary motor.

The drive control method may further comprise further providing a wiping roll motor for driving a wiping roll of the intaglio printing section, and an electric current value display unit for displaying a driving torque value of the wiping roll motor; and adjusting a torque of the auxiliary motor in accordance with an electric current value of the electric current value display unit.

The drive control method may further comprise providing a first transfer cylinder equipped with a first holding portion for passing a printing product printed by the offset printing section on to the intaglio printing section, a second transfer cylinder equipped with a second holding portion for receiving the printing product printed by the offset printing section from the offset printing section, a clutch for bringing a gear train between the first transfer cylinder and the second transfer cylinder into a connected state and a connection-released state, and a gripper release mechanism for keeping the second holding portion or the first holding portion out of contact with the first transfer cylinder or the second transfer cylinder; and driving the prime motor and the auxiliary motor independently of each other.

Another aspect of the present invention for solving the aforementioned problems is a drive control apparatus for a printing press which includes an offset printing section for doing offset printing, an intaglio printing section for doing intaglio printing, a gear train for drivingly connecting the offset printing section and the intaglio printing section, and a prime motor for driving the offset printing section and the intaglio printing section, the drive control apparatus comprising:

an auxiliary motor provided in the intaglio printing section; and a controller provided for driving the auxiliary motor in accordance with a torque value for driving the prime motor.

The drive control apparatus may further comprise a wiping roll motor for driving a wiping roll of the intaglio printing section, and the controller may drive the auxiliary motor in accordance with the torque value for driving the prime motor, and a torque value for driving the wiping roll motor.

The controller may obtain a driving torque value of the auxiliary motor from a torque for driving the prime motor, a torque distribution rate of the auxiliary motor, and a rated electric current value of the auxiliary motor.

The drive control apparatus may further comprise a wiping roll motor for driving a wiping roll of the intaglio printing section; and an electric current value display unit for displaying a driving torque value of the wiping roll motor.

The drive control apparatus may further comprise a first transfer cylinder equipped with a first holding portion for passing a printing product printed by the offset printing section on to the intaglio printing section; a second transfer cylinder equipped with a second holding portion for receiving the printing product printed by the offset printing section from the offset printing section; a clutch for bringing a gear train between the first transfer cylinder and the second transfer cylinder into a connected state and a connection-released state; and a gripper release mechanism for keeping the second holding portion or the first holding portion out of contact with the first transfer cylinder or the second transfer cylinder, and the controller may control the prime motor and the auxiliary motor so as to be driven independently of each other.

Advantageous Effects of Invention

According to the drive control method and apparatus for a printing press concerned with the present invention, the entire printing press is driven by the prime motor and the auxiliary motor. Moreover, the driving torque of the auxiliary motor is obtained from the driving torque of the prime motor. Thus, the driving torque distribution rate of the auxiliary motor during printing can be automatically set appropriately, and the low capacity of the prime motor can be achieved. As a result, the drive system can be downsized to make cost reduction and high speed printing possible.

Furthermore, the clutch is provided between the last transfer cylinder of the offset printing section and the first transfer cylinder of the intaglio printing section, and the gripper release mechanism is provided in the last transfer cylinder of the offset printing section. Thus, the respective printing sections can be driven independently and smoothly. As a result, printing preparations and settling work can be performed simultaneously in the respective printing sections, so that downtime can be shortened.

DETAILED DESCRIPTION OF THE INVENTION

Hereinafter, a drive control method and a drive control apparatus for a printing press according to the present invention will be described in detail by embodiments with reference to the accompanying drawings.

Embodiment 1

Figure 1A:
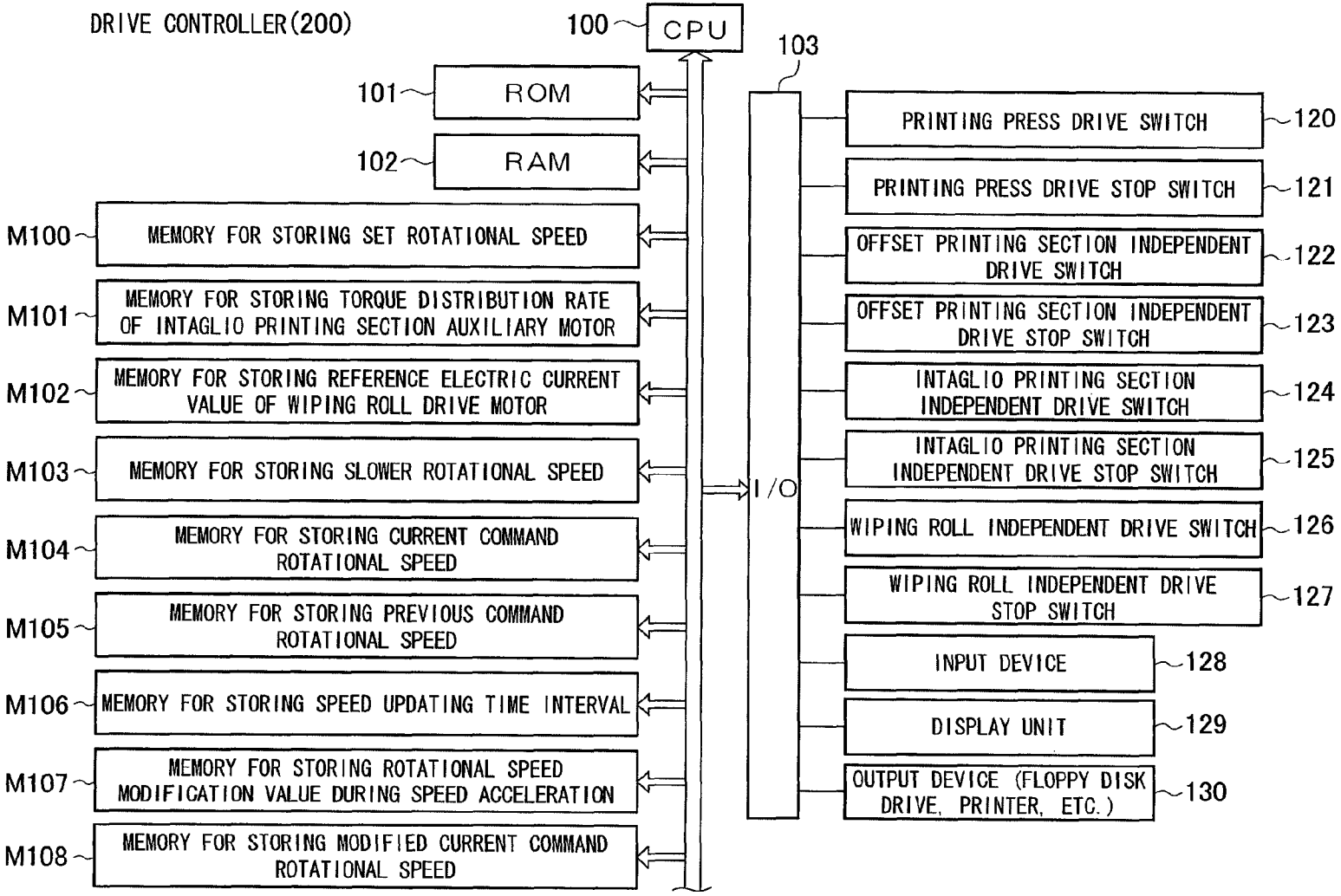
FIG. 1A is a hardware block diagram of a drive control apparatus for an offset printing section and an intaglio printing section in Embodiment 1 of the present invention.
Figure 1B:
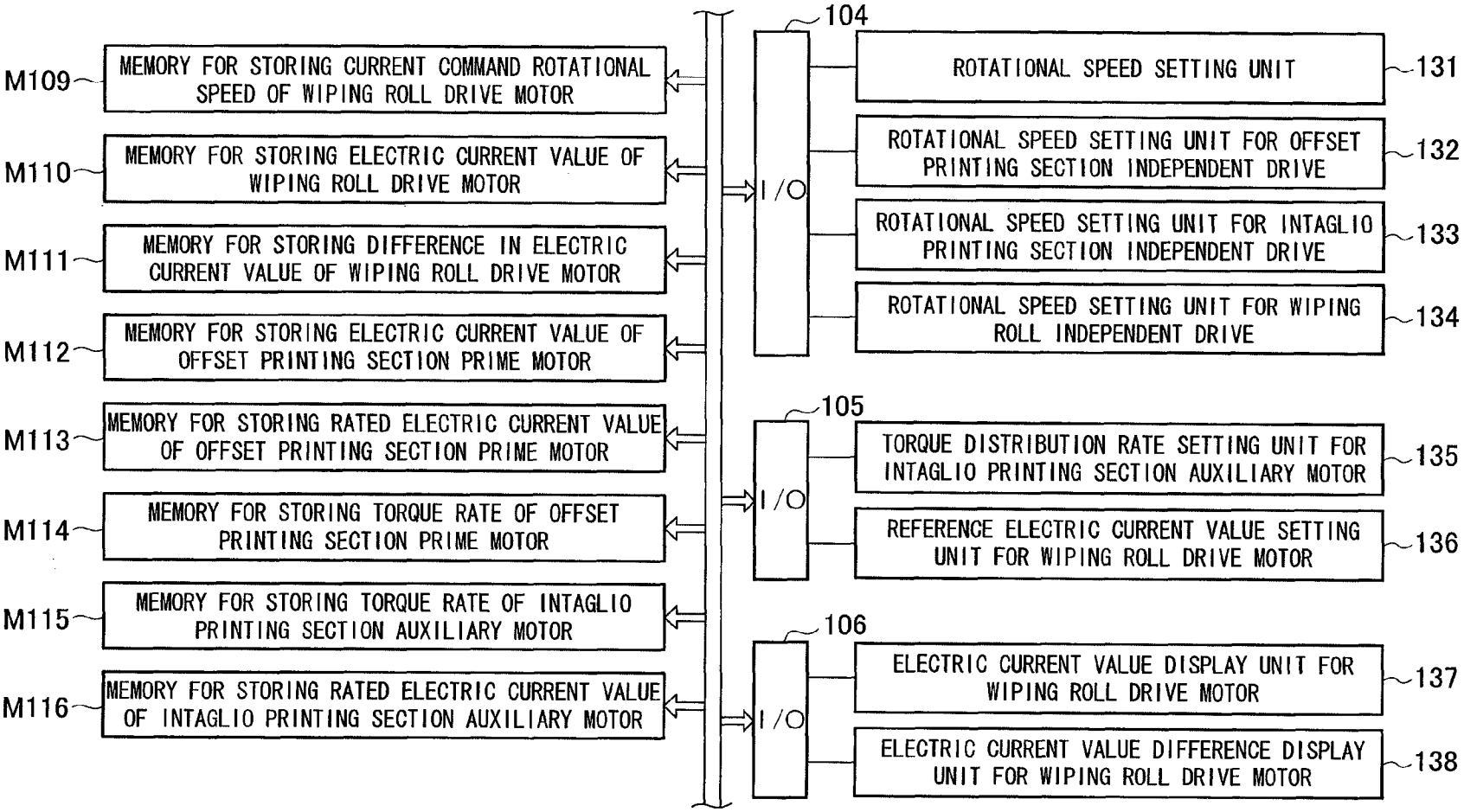
FIG. 1B is a hardware block diagram of the drive control apparatus for the offset printing section and the intaglio printing section in Embodiment 1 of the present invention.
Figure 1C:
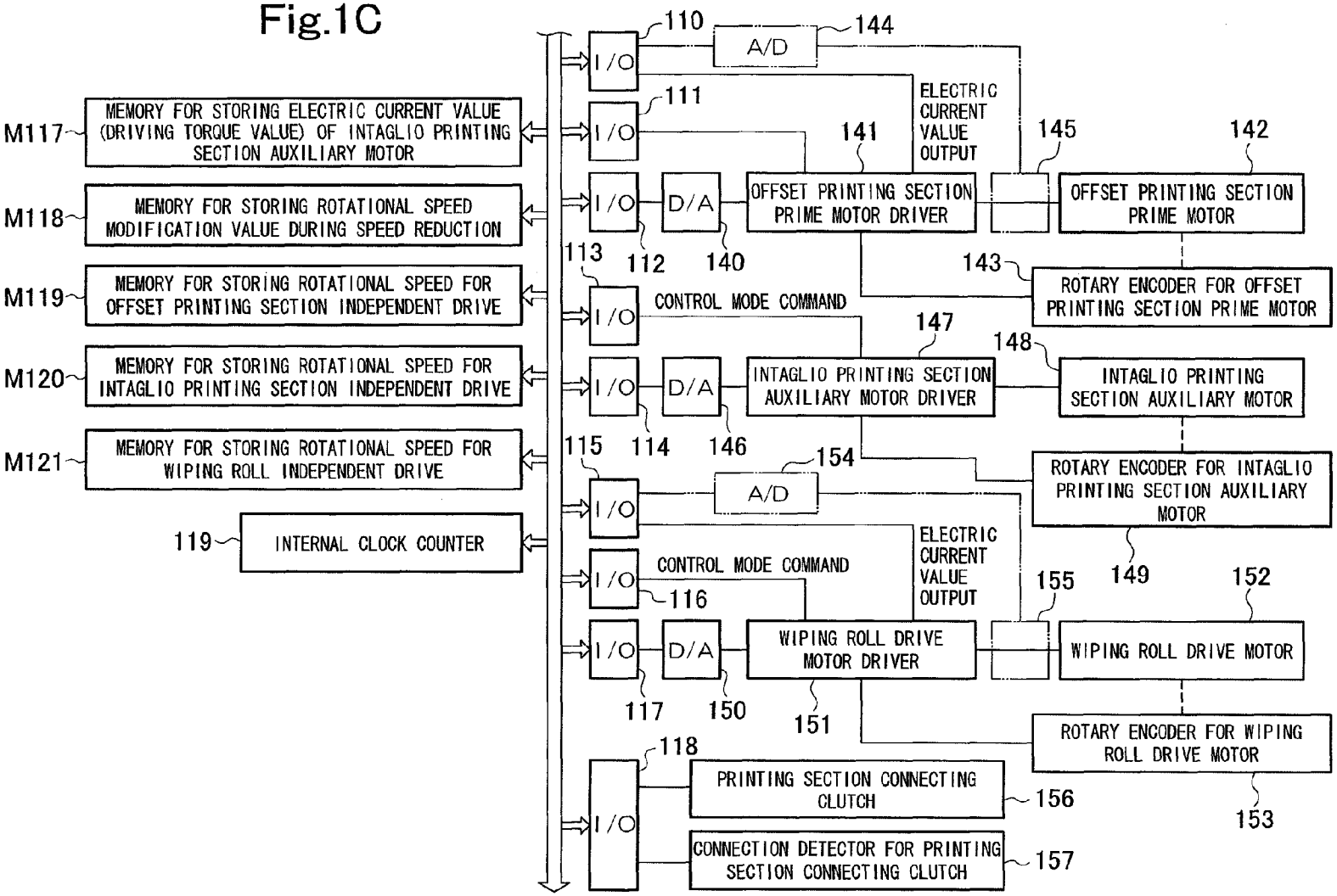
FIG. 1C is a hardware block diagram of the drive control apparatus for the offset printing section and the intaglio printing section in Embodiment 1 of the present invention.
Figure 2A:
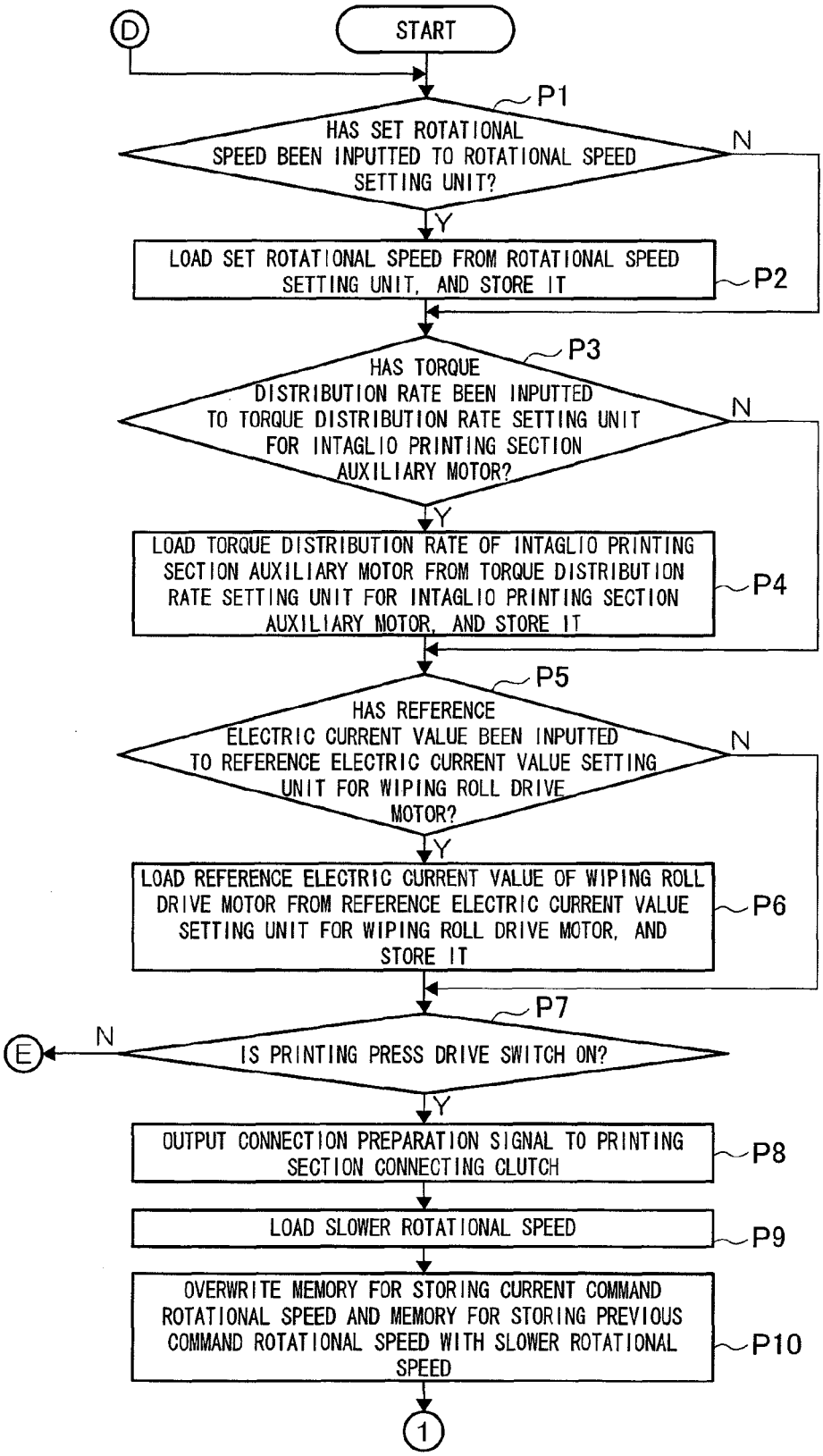
FIG. 2A is an operational or action flow chart of the drive control apparatus for the offset printing section and the intaglio printing section in Embodiment 1 of the present invention.
Figure 2B:
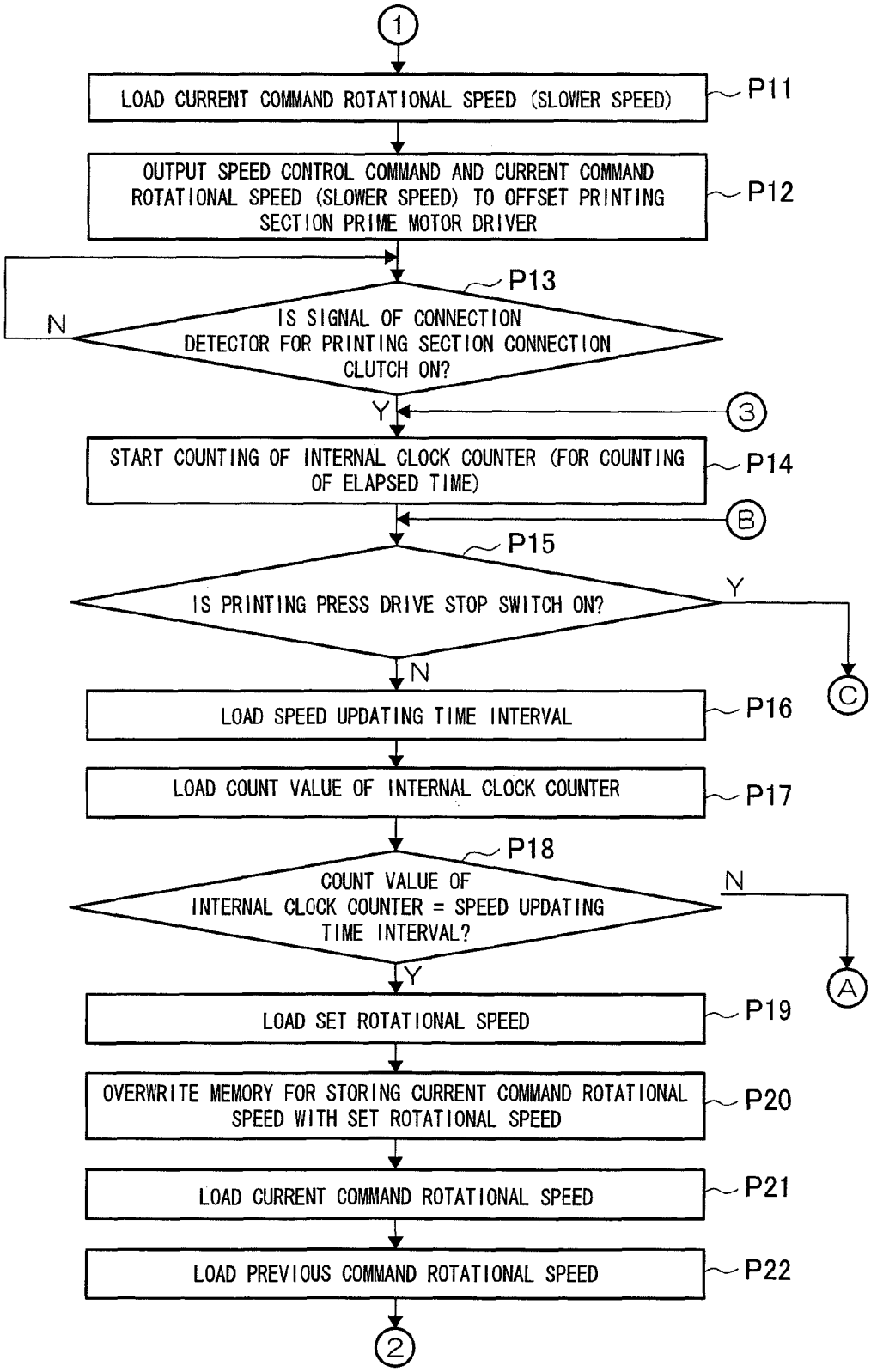
FIG. 2B is an action flow chart of the drive control apparatus for the offset printing section and the intaglio printing section in Embodiment 1 of the present invention.
Figure 2C:
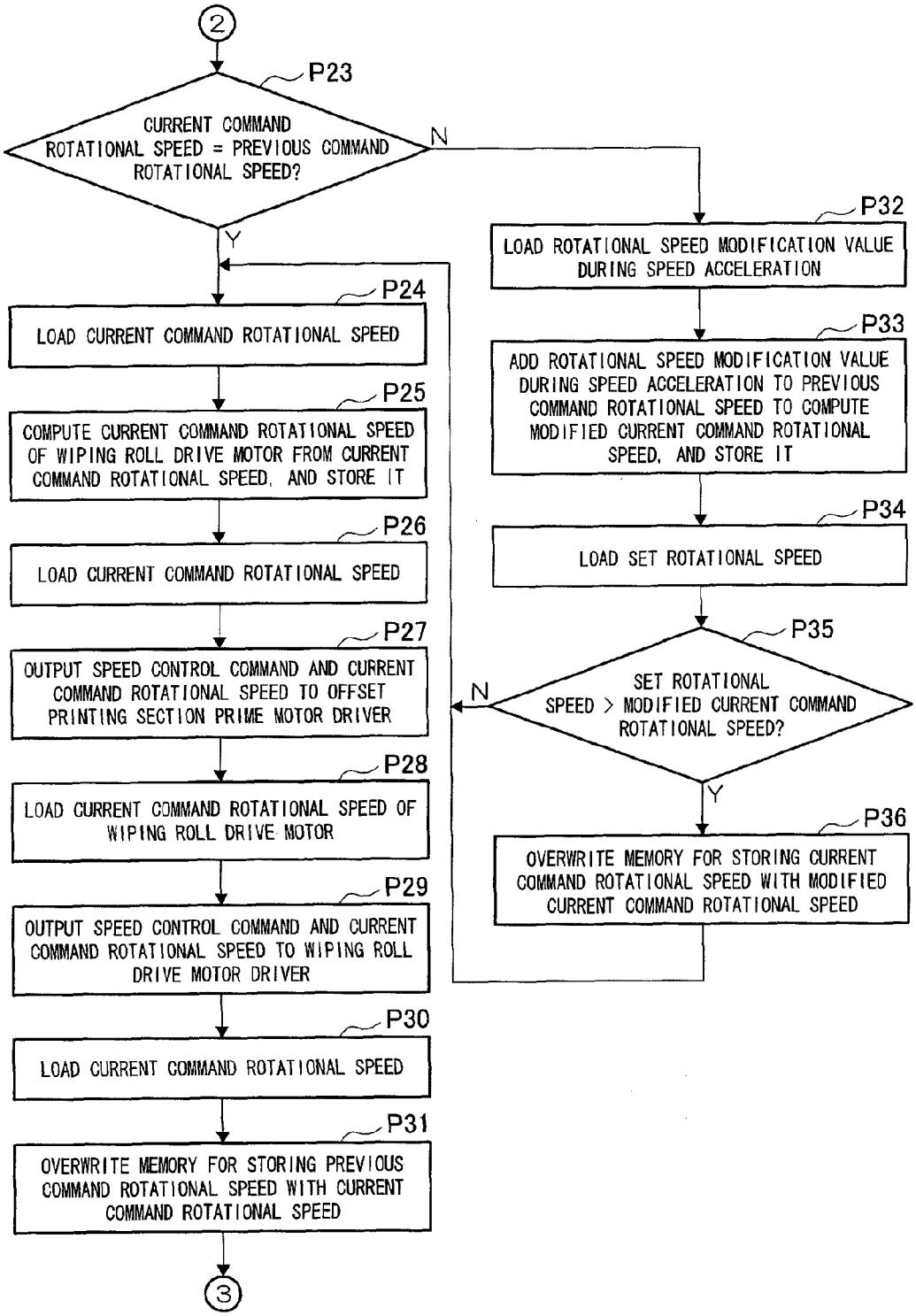
FIG. 2C is an action flow chart of the drive control apparatus for the offset printing section and the intaglio printing section in Embodiment 1 of the present invention.
Figure 3A:
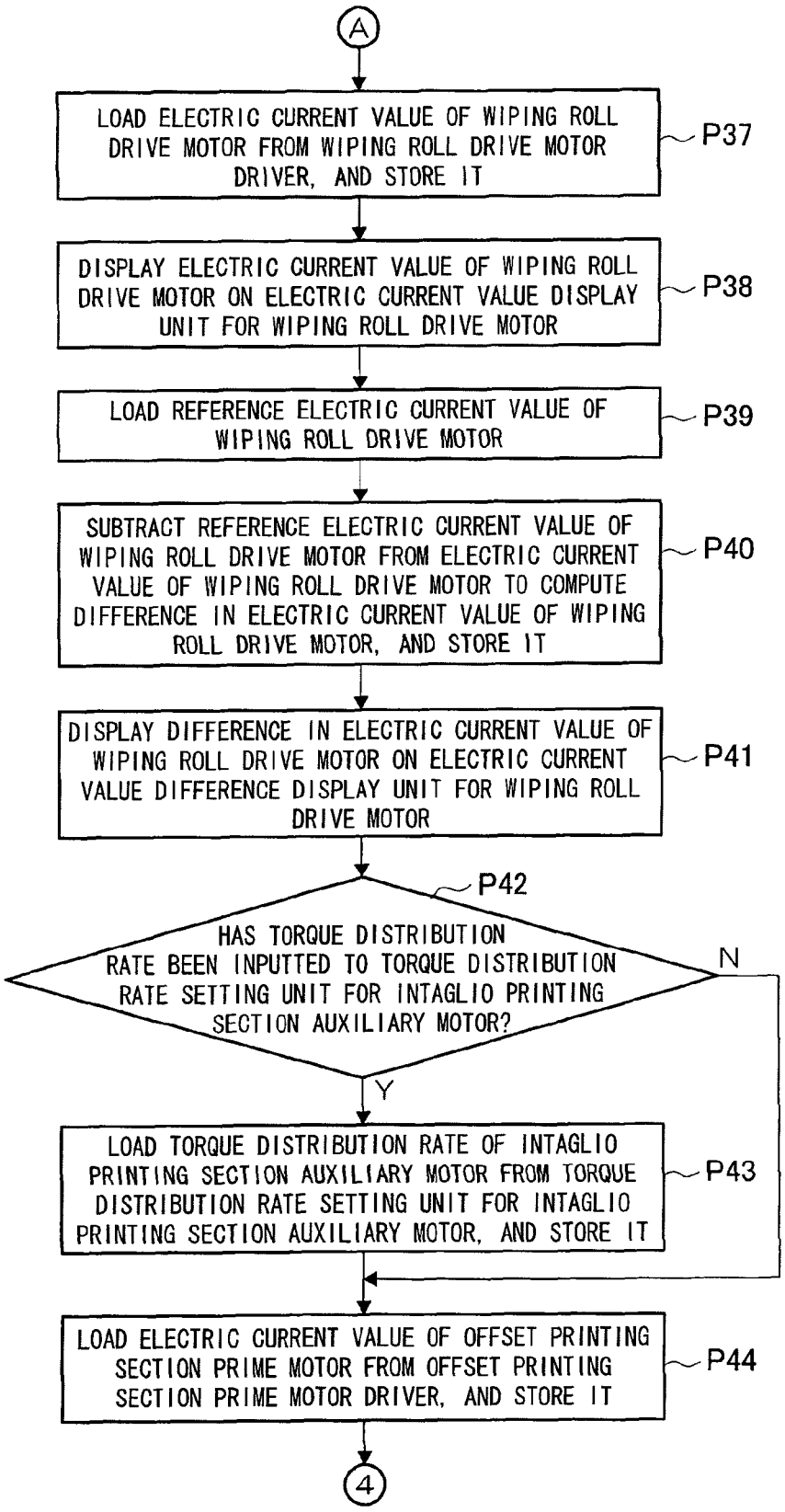
FIG. 3A is an action flow chart of the drive control apparatus for the offset printing section and the intaglio printing section in Embodiment 1 of the present invention.
Figure 3B:
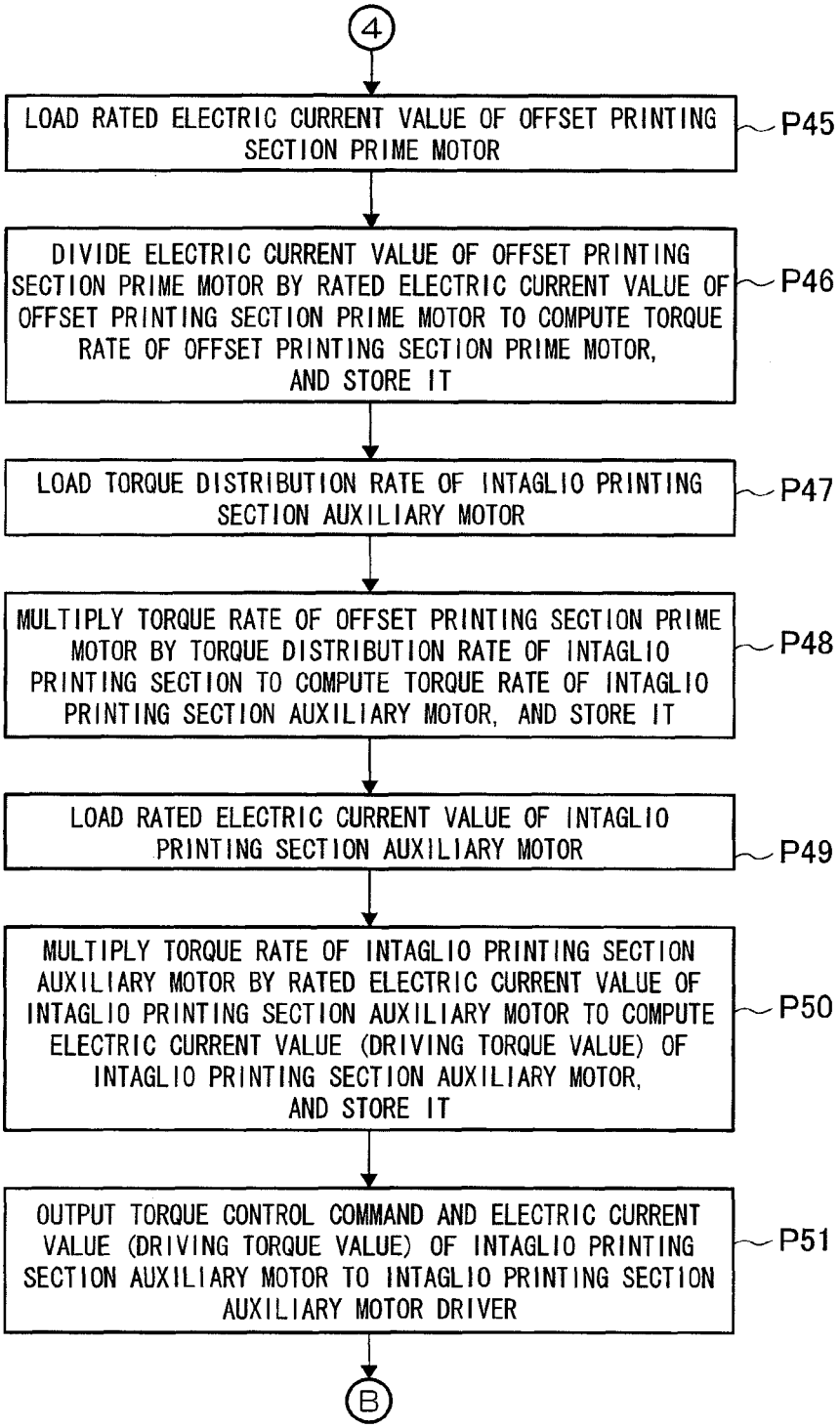
FIG. 3B is an action flow chart of the drive control apparatus for the offset printing section and the intaglio printing section in Embodiment 1 of the present invention.
Figure 4A:
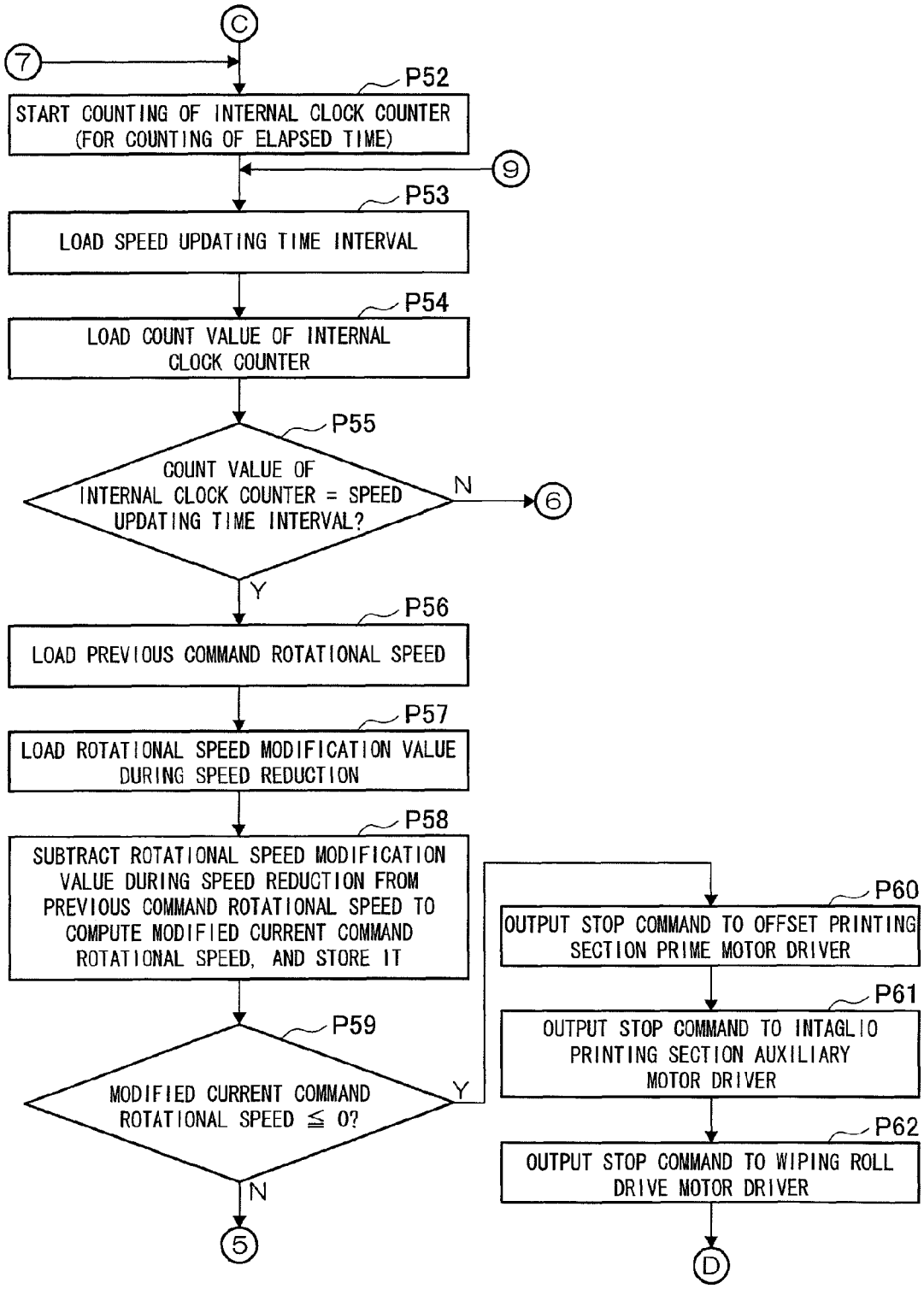
FIG. 4A is an action flow chart of the drive control apparatus for the offset printing section and the intaglio printing section in Embodiment 1 of the present invention.
Figure 4B:
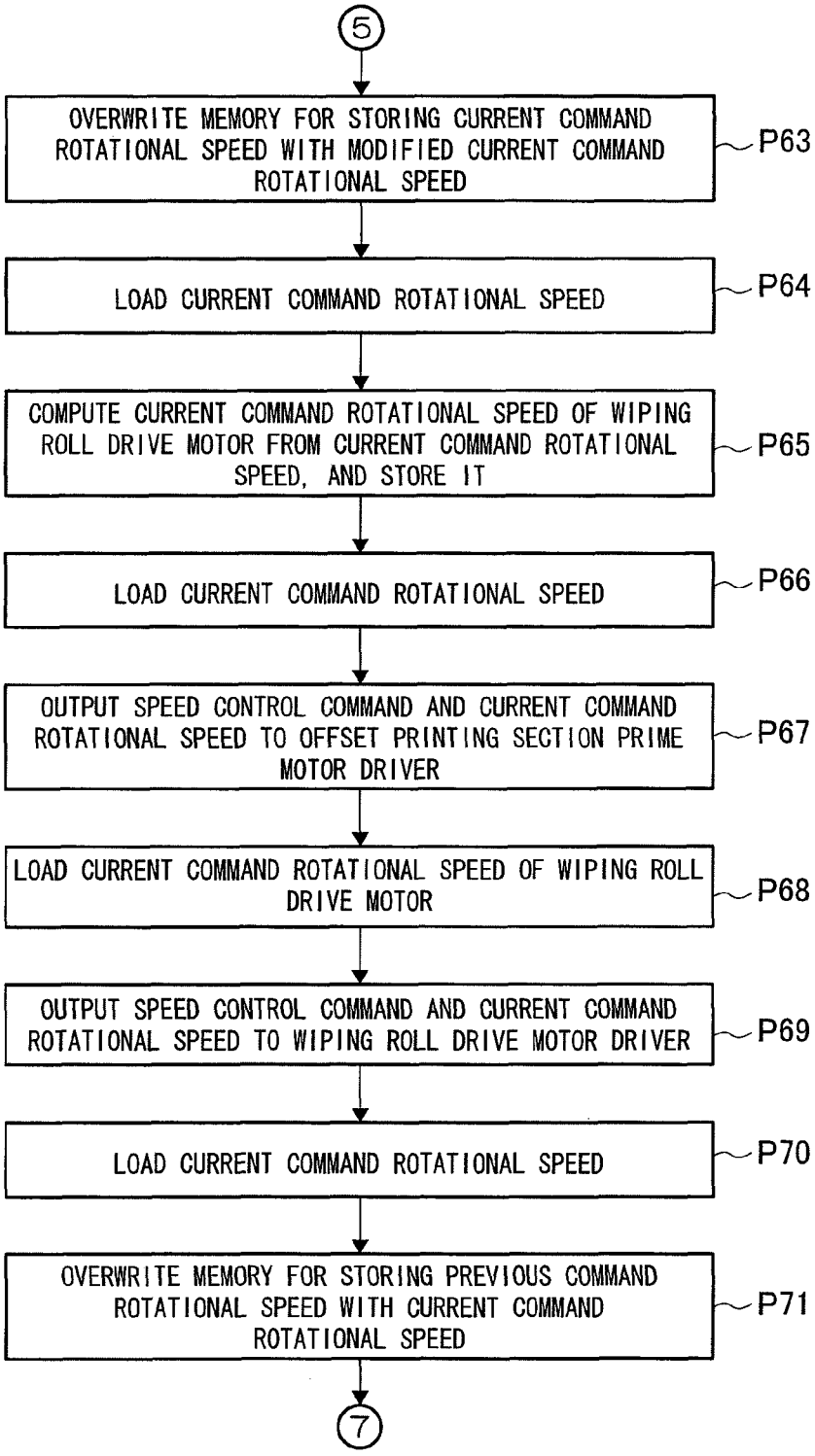
FIG. 4B is an action flow chart of the drive control apparatus for the offset printing section and the intaglio printing section in Embodiment 1 of the present invention.
Figure 4C:
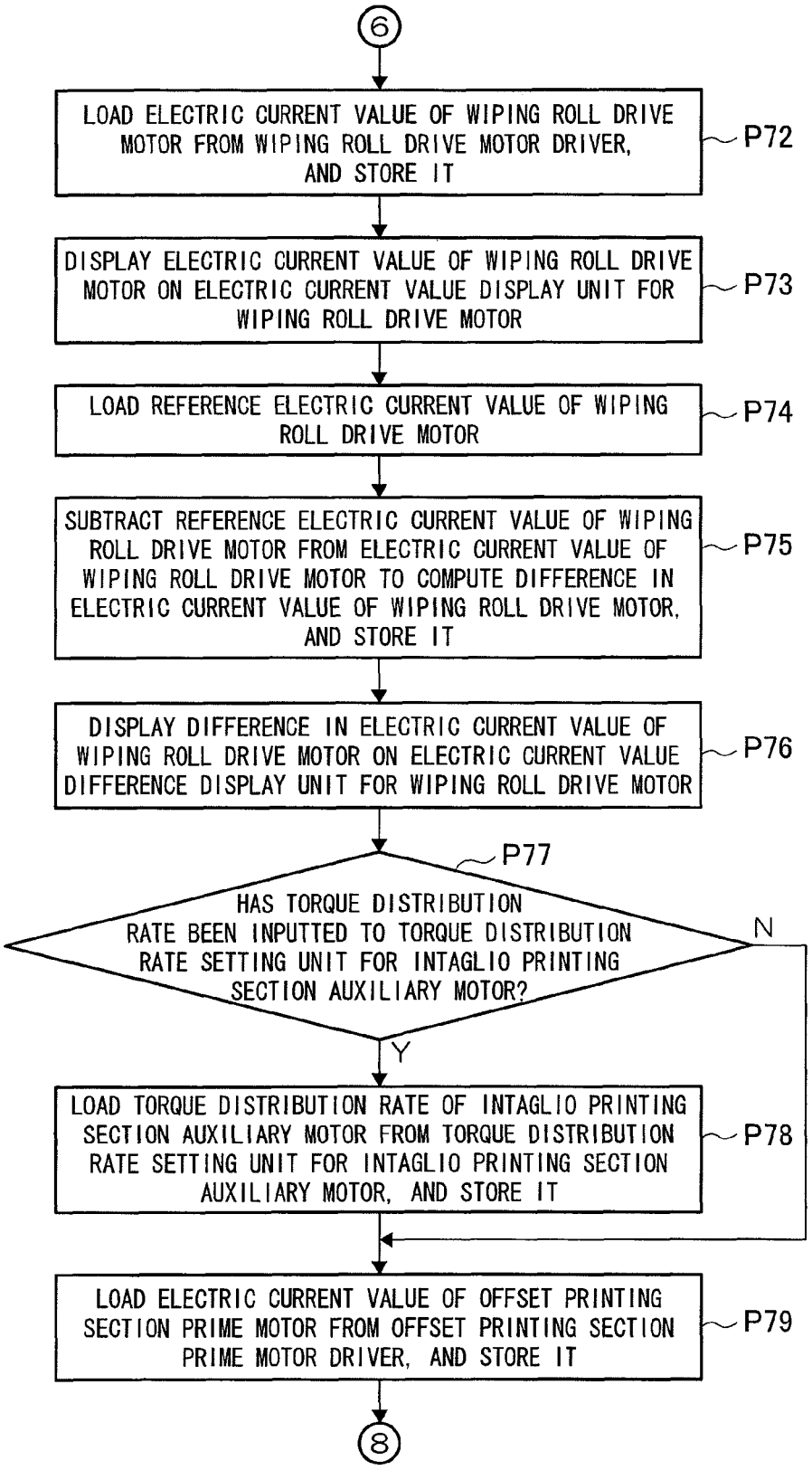
FIG. 4C is an action flow chart of the drive control apparatus for the offset printing section and the intaglio printing section in Embodiment 1 of the present invention.
Figure 4D:
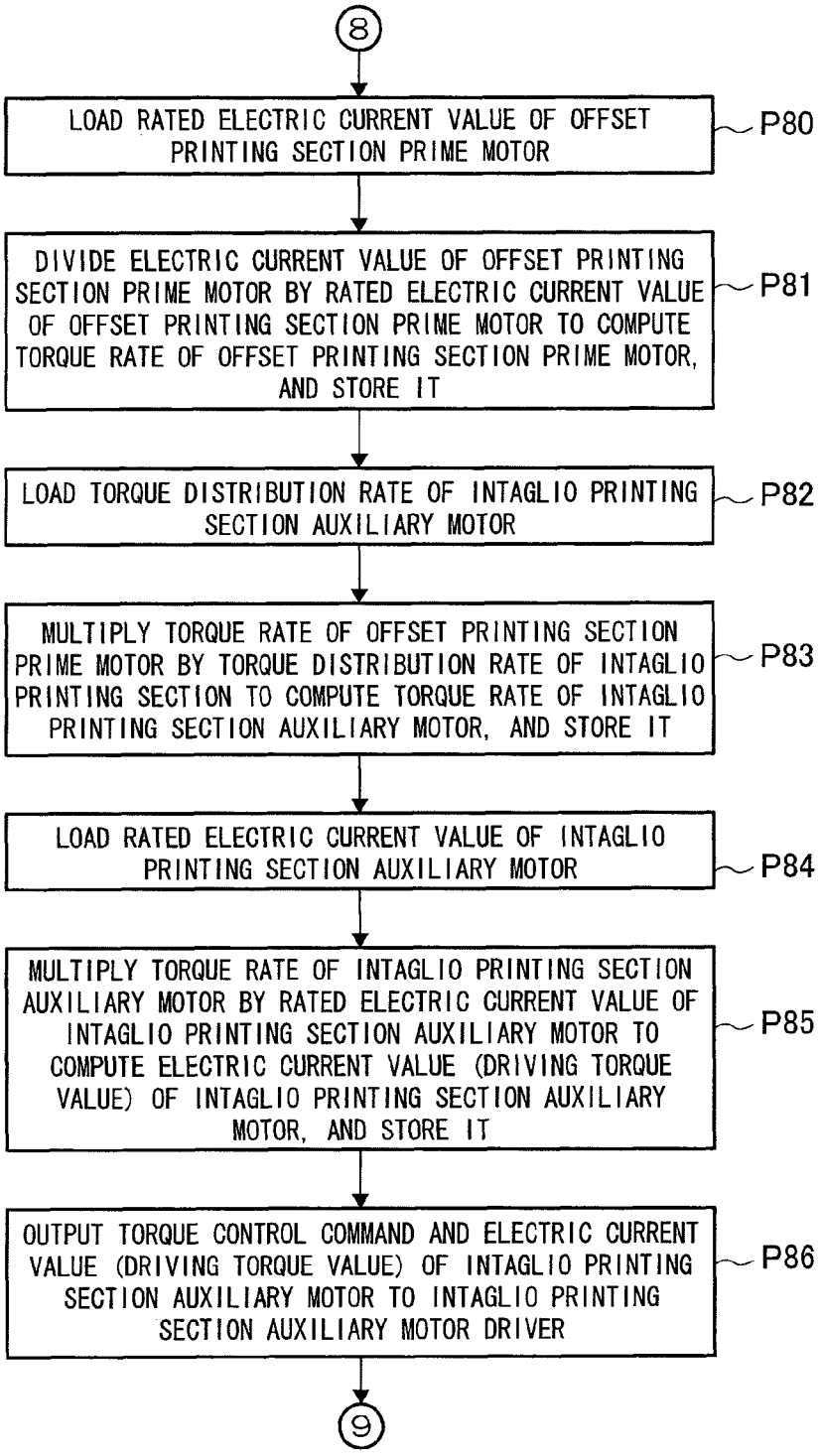
FIG. 4D is an action flow chart of the drive control apparatus for the offset printing section and the intaglio printing section in Embodiment 1 of the present invention.
Figure 5A:
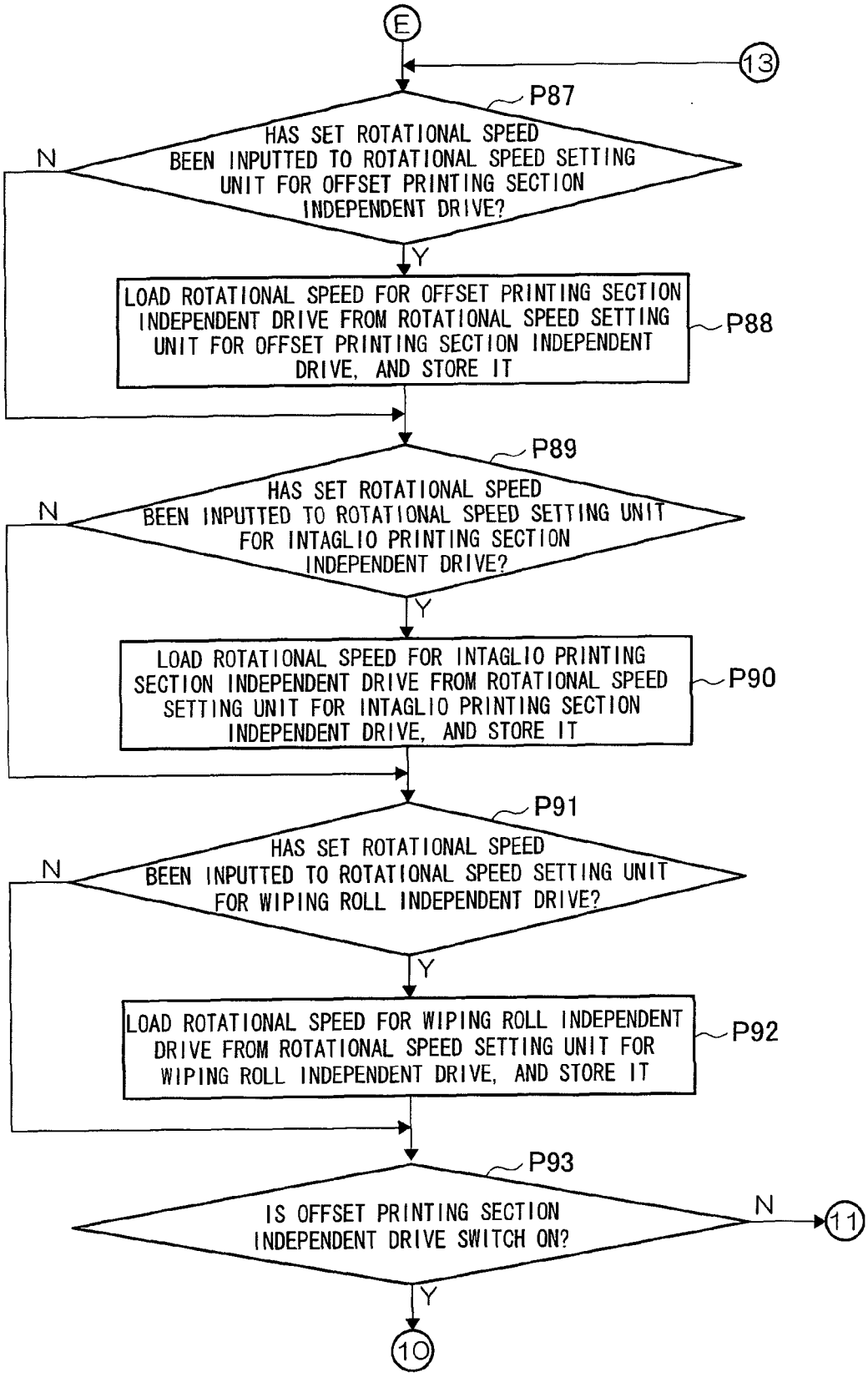
FIG. 5A is an action flow chart of the drive control apparatus for the offset printing section and the intaglio printing section in Embodiment 1 of the present invention.
Figure 5B:
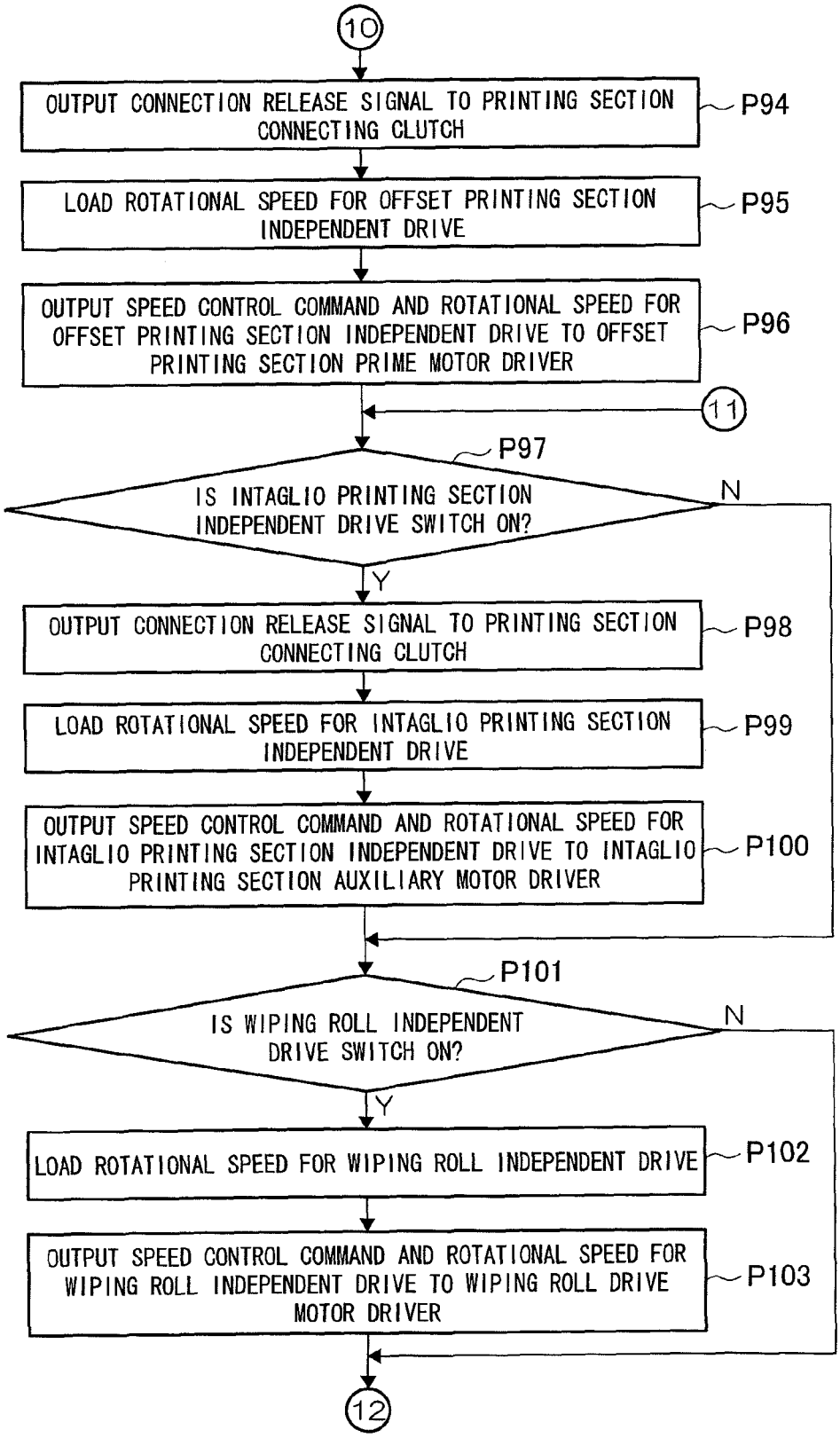
FIG. 5B is an action flow chart of the drive control apparatus for the offset printing section and the intaglio printing section in Embodiment 1 of the present invention.
Figure 5C:
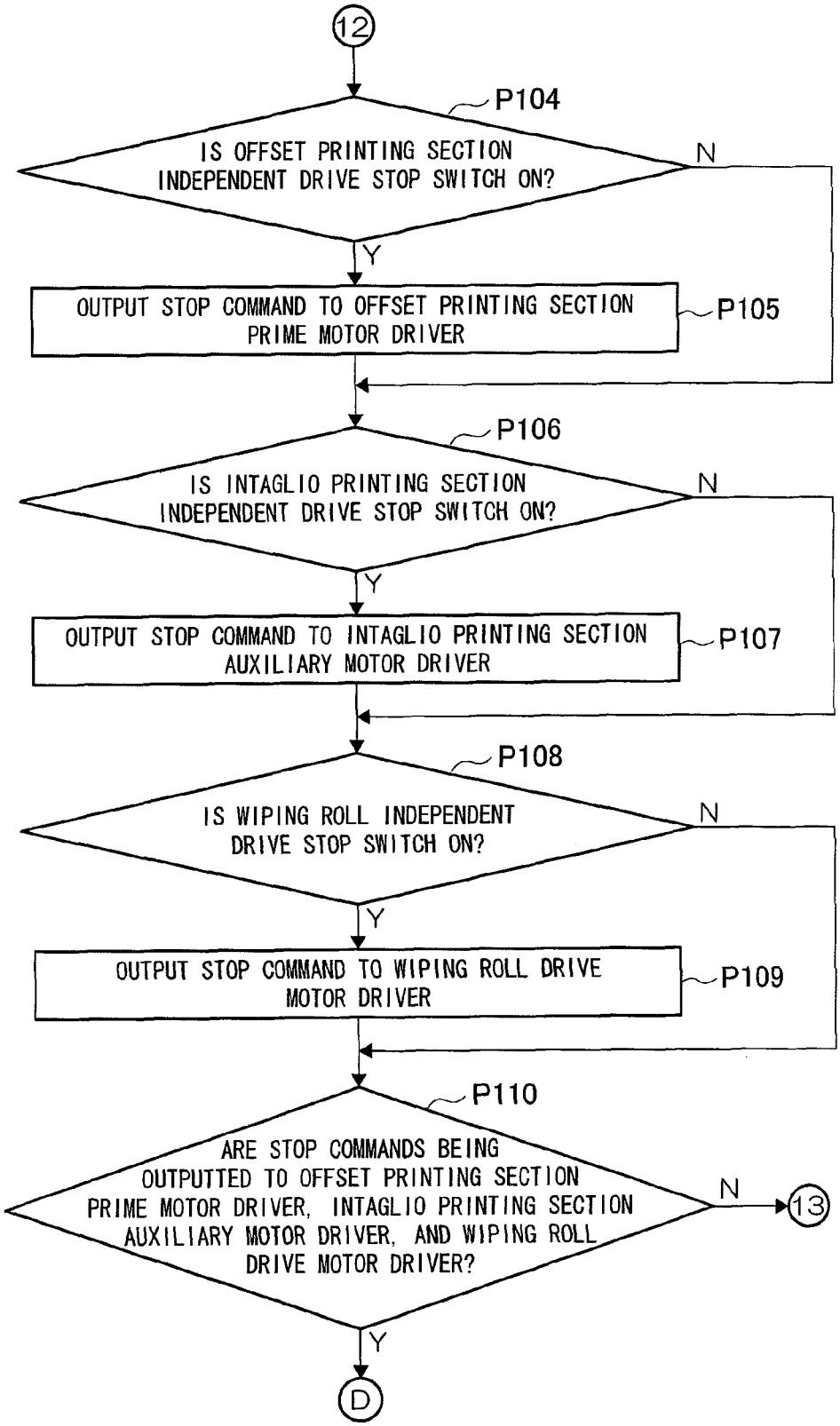
FIG. 5C is an action flow chart of the drive control apparatus for the offset printing section and the intaglio printing section in Embodiment 1 of the present invention.

FIGS. 1A to 1C are hardware block diagrams of a drive control apparatus for an offset printing section and an intaglio printing section in Embodiment 1 of the present invention.

FIGS. 2A to 2C, FIGS. 3A and 3B, FIGS. 4A to 4D, and FIGS. 5A to 5C are action flow charts of the drive control apparatus for the offset printing section and the intaglio printing section in Embodiment 1 of the present invention.

Figure 6:
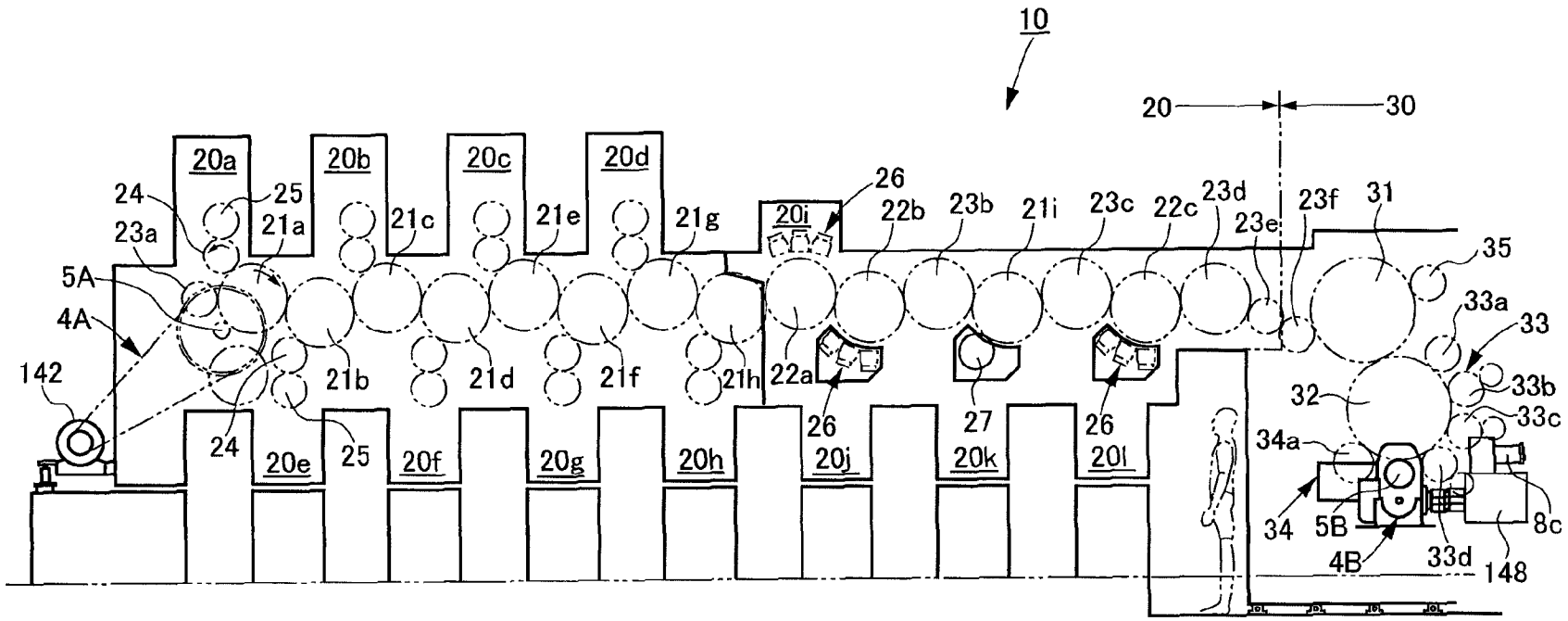
FIG. 6 is a side view showing the schematic configuration of a sheet-fed printing press.
Figure 7:
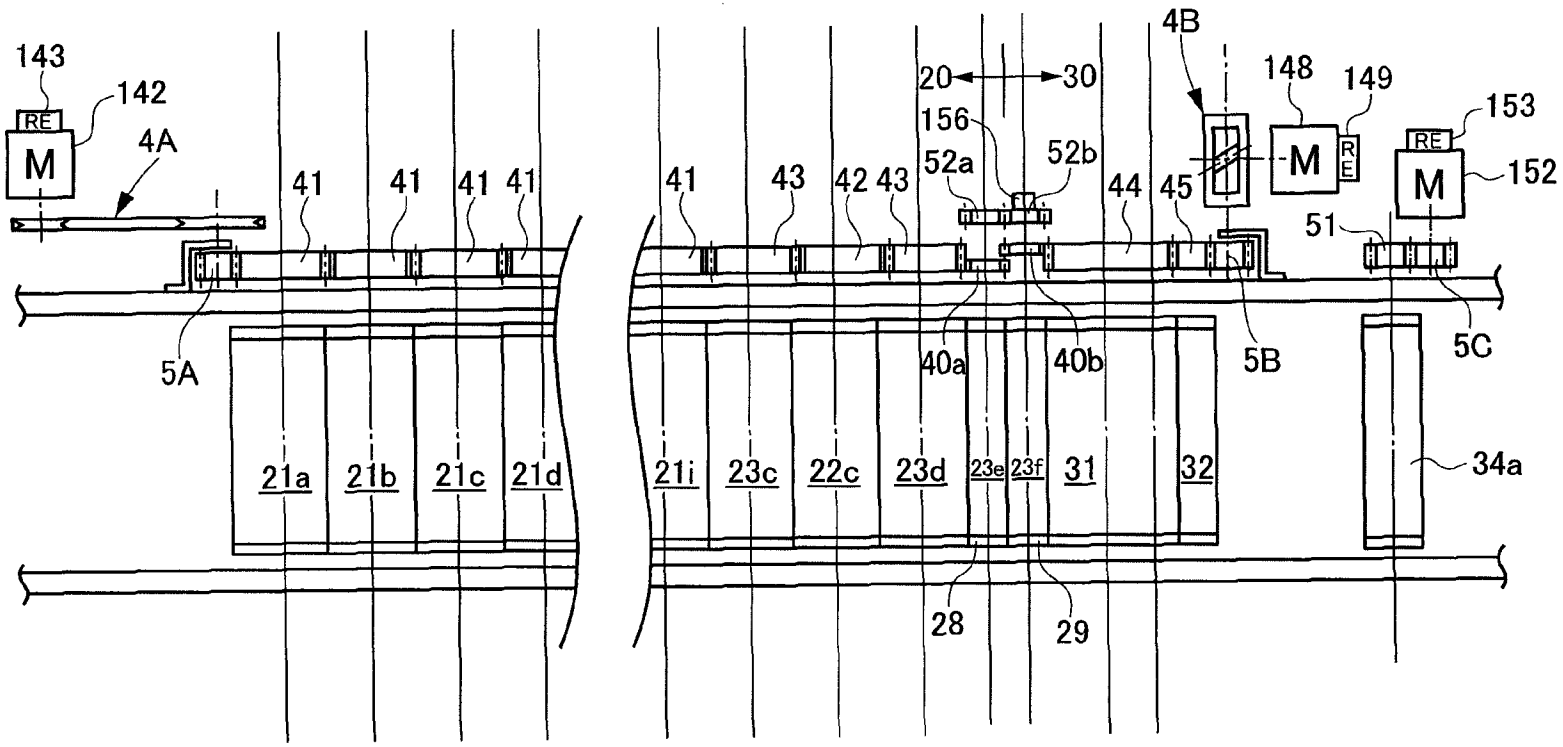
FIG. 7 is a plan view showing a gear train of the sheet-fed printing press.
Figure 8:
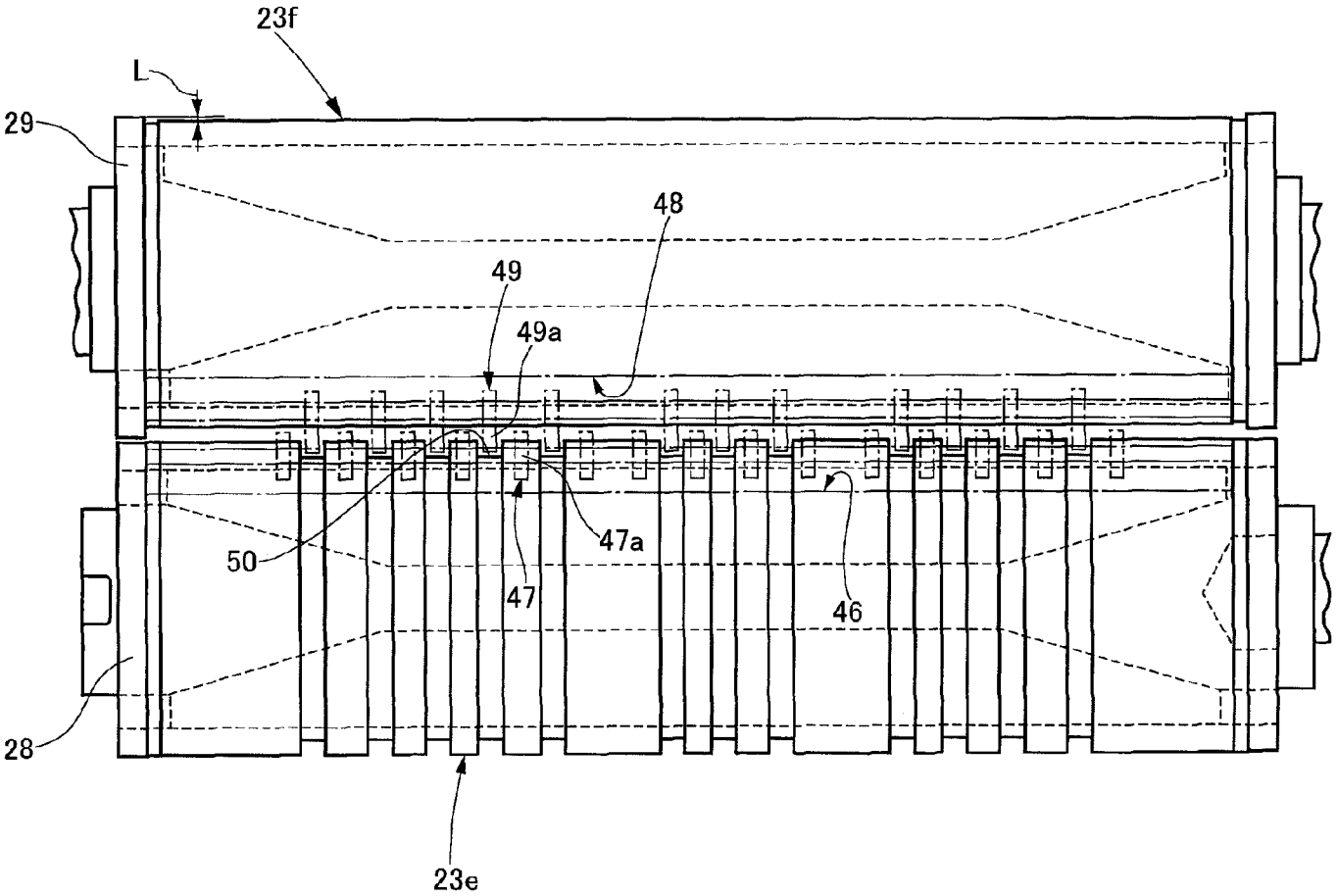
FIG. 8 is a plan view showing a configuration between transfer cylinders in the offset printing section and the intaglio printing section of the sheet-fed printing press.

FIG. 6 is a side view showing the schematic configuration of a sheet-fed printing press. FIG. 7 is a plan view showing a gear train of the sheet-fed printing press. FIG. 8 is a plan view showing a configuration between transfer cylinders in the offset printing section and the intaglio printing section of the sheet-fed printing press.

In the present embodiment, as shown in FIG. 6, a sheet-fed printing press (printing press) 10 has an offset printing section 20 continuous with a feeder (not shown), an intaglio printing section 30 continuous therewith, and a delivery unit (not shown) continuous with the intaglio printing section 30.

The offset printing section 20 further comprises offset face-side printing units 20*a* to 20*d* and offset back-side printing units 20*e* to 20*h* for a first color to a fourth color, a face-side drying unit 20*i* and a back-side drying unit 20*j*, a rotary screen printing unit 20*k*, and a drying unit 20*l*.

In the offset printing section 20, nine impression cylinders 21*a* to 21*i*, three drying cylinders 22*a* to 22*c*, and three transfer cylinders 23*b* to 23*d* are of the same diameter and arranged nearly horizontally in the sheet flow direction. A transfer cylinder 23*a* for passing a sheet from the feeder on to the offset printing section 20 is in contact with the foremost impression cylinder 21*a* (for the first color). A transfer cylinder 23*e* for passing the sheet from the offset printing section 20 on to the intaglio printing section 30 is in contact with the rearmost transfer cylinder 23*d*.

Plate cylinders 25 are in contact with the respective impression cylinders 21*a* to 21*h* of the offset face-side printing units 20*a* to 20*d* and the offset back-side printing units 20*e* to 20*h* for the first color to the fourth color via blanket cylinders 24. A set of three drying devices 26 oppose the circumferential surface of each of the drying cylinders 22*a* to 22*c* of the face-side drying unit 20*i*, the back-side drying unit 20*j* and the drying unit 20*l*. A rotary screen cylinder 27 is in contact with the impression cylinder 21*i* of the rotary screen printing unit 20*k*.

In the offset printing section 20, therefore, the sheet (printing product) transferred from the feeder via the transfer cylinder 23*a* is subjected to double-sided offset printing by the offset face-side printing units 20*a* to 20*d* and the offset back-side printing units 20*e* to 20*h* for the first color to the fourth color, and is then dried by the face-side drying unit 20*i* and the back-side drying unit 20*j*. Then, the sheet is subjected to screen printing by the rotary screen printing unit 20*k*, then dried by the drying unit 20*l*, and passed on to the intaglio printing section 30 (to be described later) by the transfer cylinder 23*e*.

In the intaglio printing section 30, an impression cylinder 31 has a diameter twice that of the impression cylinders 21*a* to 21*i*, the drying cylinders 22*a* to 22*c*, and the transfer cylinders 23*b* to 23*d* of the offset printing section 20. An intaglio cylinder 32 having the same diameter as that of the impression cylinder 31 is in contact with the impression cylinder 31. Four ink form rollers 33*a* to 33*d* of an inking device 33 are in contact with the intaglio cylinder 32, and a wiping roll 34*a* of a wiping device 34 is in contact with the intaglio cylinder 32. A transfer cylinder 23*f* and a delivery cylinder 35 are in contact with the impression cylinder 31. The transfer cylinder 23*f* contacts the transfer cylinder 23*e* of the offset printing section 20, receives the sheet from the offset printing section 20, and passes it on to the intaglio printing section 30. The discharge cylinder 35 transfers the sheet from the intaglio printing section 30 to the delivery unit.

In the intaglio printing section 30, therefore, intaglio printing is applied to the sheet which has been subjected to double-sided offset printing and screen printing in the offset printing section 20, and then the sheet is discharged to the delivery unit.

In the impression cylinders 21*a* to 21*i* and 31, the drying cylinders 22*a* to 22*c*, the transfer cylinder 23*a* to 23*f*, and the delivery cylinder 35, holding portions for holding the sheet, such as gripper devices, are mounted within gaps or notches, whereby the sheet being transported is transferred between the respective cylinders.

Between the transfer cylinder 23*e* of the offset printing section 20 and the transfer cylinder 23*f* of the intaglio printing section 30, for example, gripper devices 47, 49 are mounted within gaps or notches 46, 48, and gripper release mechanisms for many grippers 47*a*, 49*a* in these gripper devices 47, 49 are provided, as shown in FIG. 8.

As the gripper release mechanism of the transfer cylinder 23*e*, annular grooves 50 are formed at positions of the circumferential surface of the transfer cylinder 23*e* which correspond to the positions of the grippers 49*a* of the transfer cylinder 23*f*. Leading end parts of the greatly protruding grippers 49*a* on the receiving side are inserted into these annular grooves 50, whereby interference (contact or the like) by the respective grippers with each other is avoided. As the gripper release mechanism of the transfer cylinder 23*f*, the transfer cylinder 23*f* is formed to be smaller in diameter than the bearer 29 by a dimension L, thereby avoiding interference (contact or the like) with the leading end parts of the grippers 47*a* on the transferring side whose protrusion amounts are smaller than those of the grippers 49*a* on the receiving side. In FIG. 8, the numeral 28 denotes the bearer of the transfer cylinder 23*e*, and the numeral 29 denotes the bearer of the transfer cylinder 23*f*.

In the present embodiment, as shown in FIG. 7, the offset printing section 20 is driven by an offset printing section prime motor (prime motor) 142 via a wrapping transmission device such as a belt 4A. On the other hand, the intaglio printing section 30 is driven by an intaglio printing section auxiliary motor (auxiliary motor) 148 via a worm gear mechanism 4B.

That is, a gear 40*a* of the last transfer cylinder 23*e* in the offset printing section 20 (1st transfer cylinder) and a gear 40*b* of the first transfer cylinder 23*f* in the intaglio printing section 30 (2nd transfer cylinder) do not mesh with each other. The gear 40*a* of the transfer cylinder 23*e* meshes with a gear 41 of the first impression cylinder 21*a* of the offset printing section 20 via gears 41 of the impression cylinders 21*b* to 21*i* subsequent to the first impression cylinder 21*a*, gears 42 of the drying cylinders 22*a* to 22*c*, and gears 43 of the transfer cylinders 23*b* to 23*d* to constitute a gear train of the offset printing section 20. In this configuration, the gear train can transmit the driving force of the offset printing section prime motor 142. On the other hand, the gear 40*b* of the first transfer cylinder 23*f* of the intaglio printing section 30 meshes with a gear 45 of the intaglio cylinder 32 of the intaglio printing section 30 via a gear 44 of the impression cylinder 31 to constitute a gear train of the intaglio printing section 30. The so configured gear train can transmit the driving force of the intaglio printing section auxiliary motor 148. In FIGS. 6, 7, the numerals 5A, 5B denote pinions.

The gear train between the last transfer cylinder 23*e* of the offset printing section 20 and the first transfer cylinder 23*f* of the intaglio printing section 30 is brought into a connected state or a disconnected or connection-released state via an electromagnetic printing section connecting clutch 156 which is assembled to a portion beside a gear 52*b* and which is engaged with constantly meshing gears 52*a* and 52*b* in the rotating direction only in a predetermined rotation phase. That is, when the gear train is placed in the connected state, the driving force of the offset printing section prime motor 142 is transmitted to the intaglio printing section 30. When the gear train is released from connection, the offset printing section 20 and the intaglio printing section 30 become independently drivable by the offset printing section prime motor 142 and the intaglio printing section auxiliary motor 148, respectively.

The wiping roll 34*a* in the wiping device 34 is driven by a wiping roll drive motor (wiping roll motor) 152 via a pinion 5C which meshes with a gear 51 of the wiping roll 34*a*.

A rotary encoder 143 for the offset printing section prime motor is integrally assembled to the offset printing section prime motor 142 of the offset printing section 20, and a rotary encoder 149 for the intaglio printing section auxiliary motor is integrally assembled to the intaglio printing section auxiliary motor 148 of the intaglio printing section 30. A rotary encoder 153 for the wiping roll drive motor is integrally assembled to the wiping roll drive motor 152 of the wiping device 34.

In the present embodiment, the offset printing section prime motor 142, the intaglio printing section auxiliary motor 148, and the wiping roll drive motor 152 are drivingly controlled by a drive control apparatus or controller (controller) 200 (to be described later) for the offset printing section and the intaglio printing section.

As shown in FIGS. 1A to 1C, the drive controller 200 is composed of CPU 100, ROM 101, RAM 102, input/output devices 103 to 106, 110 to 118, and an internal clock counter 119 which are interconnected by BUS (bus line).

To the BUS, the following memories are connected: a memory M100 for storing a set rotational speed; a memory M101 for storing the torque distribution rate of the intaglio printing section auxiliary motor; a memory M102 for storing the reference electric current value of the wiping roll drive motor; a memory M103 for storing a slower rotational speed; a memory M104 for storing a current command rotational speed; a memory M105 for storing a previous command rotational speed; a memory M106 for storing a speed updating time interval (namely, a time interval at which the speed is updated); and a memory M107 for storing a rotational speed modification value during speed acceleration.

To the BUS, the following memories are also connected: a memory M108 for storing a modified current command rotational speed; a memory M109 for storing the current command rotational speed of the wiping roll drive motor; a memory M110 for storing the electric current value of the wiping roll drive motor; a memory M111 for storing a difference in the electric current value of the wiping roll drive motor; a memory M112 for storing the electric current value of the offset printing section prime motor; a memory M113 for storing the rated electric current value of the offset printing section prime motor; and a memory M114 for storing the torque rate of the offset printing section prime motor.

To the BUS, the following memories are further connected: a memory M115 for storing the torque rate of the intaglio printing section auxiliary motor; a memory M116 for storing the rated electric current value of the intaglio printing section auxiliary motor; a memory M117 for storing the electric current value (driving torque value) of the intaglio printing section auxiliary motor; a memory M118 for storing a rotational speed modification value during speed reduction; a memory M119 for storing a rotational speed for offset printing section independent drive; a memory M120 for storing a rotational speed for intaglio printing section independent drive; and a memory M121 for storing a rotational speed for wiping roll independent drive.

To the input/output device 103, the following are further connected: a printing press drive switch 120; a printing press drive stop switch 121; an offset printing section independent drive switch 122; an offset printing section independent drive stop switch 123; an intaglio printing section independent drive switch 124; an intaglio printing section independent drive stop switch 125; a wiping roll independent drive switch 126; a wiping roll independent drive stop switch 127; an input device 128 including a keyboard, various switches, buttons, and the like; a display unit 129 including CRT, lamps and the like; and an output device 130 including a floppy (registered trademark) disk drive, a printer, and the like.

To the input/output device 104, the following are connected: a rotational speed setting unit 131; a rotational speed setting unit 132 for offset printing section independent drive;

a rotational speed setting unit 133 for intaglio printing section independent drive; and a rotational speed setting unit 134 for independent drive of the wiping roll.

To the input/output device 105, a torque distribution rate setting unit 135 for the intaglio printing section auxiliary motor, and a reference electric current value setting unit 136 for the wiping roll drive motor are connected.

To the input/output device 106, an electric current value display unit for the wiping roll drive motor (electric current value display unit) 137, and an electric current value difference display unit 138 for the wiping roll drive motor are connected.

The input/output device 110 is connected to an offset printing section prime motor driver 141 to receive, as an input, an electric current value (torque value) outputted from the offset printing section prime motor driver 141. On this occasion, an electric current value (torque value) may be entered into the input/output device 110 from an ammeter 145, which is provided separately from the offset printing section prime motor driver 141, via an A/D converter 144.

The input/output device 111 is connected to the offset printing section prime motor driver 141 to output a control mode command to the offset printing section prime motor driver 141.

The input/output device 112 is connected to an offset printing section prime motor 142 via a D/A converter 140 and the above-mentioned offset printing section prime motor driver 141. The offset printing section prime motor driver 141 receives, as an input, a rotation rate (i.e., number of revolutions) signal from a rotary encoder 143 for the offset printing section prime motor which is connectedly driven by the offset printing section prime motor 142.

The input/output device 113 is connected to an intaglio printing section auxiliary motor driver 147 to output a control mode command to the intaglio printing section auxiliary motor driver 147.

The input/output device 114 is connected to an intaglio printing section auxiliary motor 148 via a D/A converter 146 and the above-mentioned intaglio printing section auxiliary motor driver 147. The intaglio printing section auxiliary motor driver 147 receives, as an input, a rotation rate signal from a rotary encoder 149 for the intaglio printing section auxiliary motor which is connectedly driven by the intaglio printing section auxiliary motor 148.

The input/output device 115 is connected to a wiping roll drive motor driver 151 to receive, as an input, an electric current value (torque value) outputted by the wiping roll drive motor driver 151. To the input/output device 115, an electric current value (torque value) may be inputted via an A/D converter 154 from an ammeter 155 provided separately from the wiping roll drive motor driver 151.

The input/output device 116 is connected to the wiping roll drive motor driver 151 to output a control mode command to the wiping roll drive motor driver 151.

The input/output device 117 is connected to a wiping roll drive motor 152 via a D/A converter 150 and the above-mentioned wiping roll drive motor driver 151. The wiping roll drive motor driver 151 receives, as an input, a rotation rate signal from a rotary encoder 153 for the wiping roll drive motor which is connectedly driven by the wiping roll drive motor 152.

To the input/output device 118, a printing section connecting clutch 156 and a connection detector 157 for the printing section connecting clutch are connected.

The actions of the drive controller 200 for the offset printing section and the intaglio printing section, which have been described above, will be described below.

The drive controller 200 operates in accordance with an action or operational flow shown in FIGS. 2A to 2C, FIGS. 3A, 3B, FIGS. 4A to 4D, and FIGS. 5A to 5C.

In Step P1, it is determined whether a set rotational speed has been inputted to the rotational speed setting unit 131. If the answer is yes (Y), in Step P2, the set rotational speed is loaded from the rotational speed setting unit 131, and stored into the memory M100. Then, the program shifts to Step P3. If the answer is no (N) in Step P1, the program directly shifts to Step P3.

Then, in Step P3, it is determined whether a torque distribution rate has been inputted to the torque distribution rate setting unit 135 for the intaglio printing section auxiliary motor. If the answer is Y, in Step P4, the torque distribution rate of the intaglio printing section auxiliary motor 148 is loaded from the torque distribution rate setting unit 135 for the intaglio printing section auxiliary motor, and stored into the memory M101. Then, the program shifts to Step P5. It the answer is N in Step P3, the program directly shifts to Step P5.

Then, it is determined in Step P5 whether a reference electric current value has been inputted to the reference electric current value setting unit 136 for the wiping roll drive motor. If the answer is Y, in Step P6, the reference electric current value of the wiping roll drive motor 152 is loaded from the reference electric current value setting unit 136 for the wiping roll drive motor, and stored into the memory M102. Then, the program shifts to Step P7. If the answer is N in Step P5, the program directly shifts to Step P7.

Then, in Step P7, it is determined whether the printing press drive switch 120 has been turned on. If the answer is Y, a connection preparation signal is outputted to the printing section connecting clutch 156 in Step P8. Then, the program shifts to Step P9. If the answer is N in Step P7, the program shifts to Step P87 to be described later.

Then, in Step P9, a slower rotational speed is loaded from the memory M103. In Step P10, the memory M104 for storing a current command rotational speed and the memory M105 for storing a previous command rotational speed are overwritten with the slower rotational speed. Then, in Step P11, the current command rotational speed (slower speed) is loaded from the memory M104.

Then, in Step P12, a speed control command and the current command rotational speed (slower speed) are outputted to the offset printing section prime motor driver 141. Then, in Step P13, it is determined whether the signal of the connection detector 157 for the printing section connecting clutch is ON. If the answer is Y in Step P13, counting of the internal clock counter (for counting of the elapsed time) 119 is started in Step P14.

Then, in Step P15, it is determined whether the printing press drive stop switch 121 has been turned on. If the answer is Y, the program shifts to Step P52 to be described later. If the answer is N, a speed updating time interval is loaded from the memory M106 in Step P16. Then, in Step P17, the count value of the internal clock counter 119 is loaded.

Then, in Step P18, it is determined whether the count value of the internal clock counter is equal to the speed updating time interval. If the answer is Y, the set rotational speed is loaded from the memory M100 in Step P19. Then, the program shifts to Step P20. If the answer is N in Step P18, the program shifts to Step P37 to be described later.

Then, in Step P20, the memory M104 for storing the current command rotational speed is overwritten with the set rotational speed. Then, in Step P21, the current command rotational speed is loaded from the memory M104. In Step P22, the previous command rotational speed is loaded from the memory M105.

Then, in Step P23, it is determined whether the current command rotational speed is equal to the previous command rotational speed. If the answer is Y, the current command rotational speed is loaded from the memory M104 in Step P24. Then, in Step P25, the current command rotational speed of the wiping roll drive motor 152 is computed from the current command rotational speed, and stored into the memory M109. The current command rotational speed of the wiping roll drive motor 152 is obtained by multiplying the current command rotational speed by a predetermined coefficient.

Then, in Step P26, the current command rotational speed is loaded from the memory M104. Then, in Step P27, a speed control command and the current command rotational speed are outputted to the offset printing section prime motor driver 141.

Then, in Step P28, the current command rotational speed of the wiping roll drive motor 152 is loaded from the memory M109. Then, in Step P29, a speed control command and the current command rotational speed are outputted to the wiping roll drive motor driver 151.

Then, in Step P30, the current command rotational speed is loaded from the memory M104. Then, in Step P31, the memory M105 for storing the previous command rotational speed is overwritten with the current command rotational speed. Then, the program returns to Step P14.

If the answer is N in Step P23, on the other hand, a rotational speed modification value during speed acceleration is loaded from the memory M107 in Step P32. Then, in Step P33, the rotational speed modification value during speed acceleration is added to the previous command rotational speed to compute a modified current command rotational speed, which is stored into the memory M108.

Then, in step P34, the set rotational speed is loaded from the memory M100. Then, in Step P35, it is determined whether the set rotational speed is higher than the modified current command rotational speed. If the answer is Y, in Step P36, the memory M104 for storing the current command rotational speed is overwritten with the modified current command rotational speed. Then, the program shifts to Step P24. If the answer is N in Step P35, the program directly shifts to Step P24.

In accordance with the above-described operational or action flow, the speed switching control of the sheet-fed printing press 10, namely, the offset printing section prime motor 142 (and the intaglio printing section auxiliary motor 148) and the wiping roll drive motor 152, takes place.

Then, in Step P37 to which the program has shifted from the aforementioned Step P18, the electric current value of the wiping roll drive motor 152 is loaded from the wiping roll drive motor driver 151, and stored into the memory M110. Then, in Step P38, the electric current value of the wiping roll drive motor 152 is displayed on the electric current value display unit 137 for the wiping roll drive motor.

Then, in Step P39, the reference electric current value of the wiping roll drive motor 152 is loaded from the memory M102. Then, in Step P40, the reference electric current value of the wiping roll drive motor 152 is subtracted from the electric current value of the wiping roll drive motor 152 to compute the difference in the electric current value of the wiping roll drive motor 152, which is stored into the memory M111.

Then, in Step P41, the difference in the electric current value of the wiping roll drive motor 152 is displayed on the electric current value difference display unit 138 for the wiping roll drive motor. Then, in Step P42, it is determined whether the torque distribution rate has been inputted to the torque distribution rate setting unit 135 for the intaglio printing section auxiliary motor.

If the answer is Y in Step P42, the torque distribution rate of the intaglio printing section auxiliary motor 148 is loaded from the torque distribution rate setting unit 135 for the intaglio printing section auxiliary motor, and stored into the memory M101 in Step P43. Then, the program shifts to Step P44. If the answer is N in Step P42, the program directly shifts to Step P44.

Then, in Step P44, the electric current value of the offset printing section prime motor 142 is loaded from the offset printing section prime motor driver 141, and stored into the memory M112. Then, in Step P45, the rated electric current value of the offset printing section prime motor 142 is loaded from the memory M113.

Then, in Step P46, the electric current value of the offset printing section prime motor 142 is divided by the rated electric current value of the offset printing section prime motor 142 to compute the torque rate of the offset printing section prime motor 142, which is stored into the memory M114. Then, in Step P47, the torque distribution rate of the intaglio printing section auxiliary motor 148 is loaded from the memory M101.

Then, in Step P48, the torque rate of the offset printing section prime motor 142 is multiplied by the torque distribution rate of the intaglio printing section auxiliary motor 148 to compute the torque rate of the intaglio printing section auxiliary motor 148, which is stored into the memory M115. Then, in Step P49, the rated electric current value of the intaglio printing section auxiliary motor 148 is loaded from the memory M116.

Then, in Step P50, the torque rate of the intaglio printing section auxiliary motor 148 is multiplied by the rated electric current value of the intaglio printing section auxiliary motor 148 to compute the electric current value (driving torque value) of the intaglio printing section auxiliary motor 148, which is stored into the memory M117. Then, in Step P51, a torque control command and the electric current value (driving torque value) of the intaglio printing section auxiliary motor 148 are outputted to the intaglio printing section auxiliary motor driver 147, and the program returns to Step P15.

As a result of the above-described operational or action flow, the electric current value (driving torque value) of the intaglio printing section auxiliary motor 148 is controlled in accordance with the electric current value (torque value) for driving the offset printing section prime motor 142, the torque distribution rate of the intaglio printing section auxiliary motor 148, and the rated electric current value of the intaglio printing section auxiliary motor 148.

Then, in Step P52 to which the program has shifted from the aforementioned Step P15, counting of the internal clock counter (for counting of the elapsed time) 119 is started. Then, in Step P53, the speed updating time interval is loaded from the memory M106.

Then, in Step P54, the count value of the internal clock counter 119 is loaded. Then, in Step P55, it is determined whether the count value of the internal clock counter is equal to the speed updating time interval. If the answer is Y, the previous command rotational speed is loaded from the memory M105 in Step P56. If the answer is N in Step P55, on the other hand, the program shifts to Step P72 to be described later.

Then, in Step P57, a rotational speed modification value during speed reduction is loaded from the memory M118. Then, in Step P58, the rotational speed modification value during speed reduction is subtracted from the previous command rotational speed to compute a modified current command rotational speed, which is stored into the memory M108.

Then, in Step P59, it is determined whether the modified current command rotational speed is equal to or less than zero. If the answer is Y, in Step P60, a stop command is outputted to the offset printing section prime motor driver 141. In Step P61, a stop command is outputted to the intaglio printing section auxiliary motor driver 147. Further, in Step P62, a stop command is outputted to the wiping roll drive motor driver 151. Then, the program returns to Step P1.

If the answer is N in Step P59, the memory M104 for storing the current command rotational speed is overwritten with the modified current command rotational speed in Step P63. Then, in Step P64, the current command rotational speed is loaded from the memory M104.

Then, in Step P65, the current command rotational speed of the wiping roll drive motor 152 is computed from the current command rotational speed, and stored into the memory M109. Then, in Step P66, the current command rotational speed is loaded from the memory M104.

Then, in Step P67, a speed control command and the current command rotational speed are outputted to the offset printing section prime motor driver 141. Then, in Step P68, the current command rotational speed of the wiping roll drive motor 152 is loaded from the memory M109.

Then, in Step P69, a speed control command and the current command rotational speed are outputted to the wiping roll drive motor driver 151. Then, in Step P70, the current command rotational speed is loaded from the memory M104. Then, in Step P71, the memory M105 for storing the previous command rotational speed is overwritten with the current command rotational speed, and the program returns to Step P53.

Then, in the aforementioned Step P72, the electric current value of the wiping roll drive motor 152 is loaded from the wiping roll drive motor driver 151, and stored into the memory M110. Then, in Step P73, the electric current value of the wiping roll drive motor 152 is displayed on the electric current value display unit 137 for the wiping roll drive motor.

Then, in Step P74, the reference electric current value of the wiping roll drive motor 152 is loaded from the memory M102. Then, in Step P75, the reference electric current value of the wiping roll drive motor 152 is subtracted from the electric current value of the wiping roll drive motor 152 to compute the difference in the electric current value of the wiping roll drive motor 152, which is stored into the memory M111.

Then, in Step P76, the difference in the electric current value of the wiping roll drive motor 152 is displayed on the electric current value difference display unit 138 for the wiping roll drive motor. Then, in Step P77, it is determined whether a torque distribution rate has been inputted to the torque distribution rate setting unit 135 for the intaglio printing section auxiliary motor.

If the answer is Y in Step P77, the torque distribution rate of the intaglio printing section auxiliary motor 148 is loaded from the torque distribution rate setting unit 135 for the intaglio printing section auxiliary motor, and stored into the memory M101 in Step P78. Then, the program shifts to Step P79. If the answer is N in Step P77, the program directly shifts to Step P79.

Then, in Step P79, the electric current value of the offset printing section prime motor 142 is loaded from the offset printing section prime motor driver 141, and stored into the memory M112. Then, in Step P80, the rated electric current value of the offset printing section prime motor 142 is loaded from the memory M113.

Then, in Step P81, the electric current value of the offset printing section prime motor 142 is divided by the rated electric current value of the offset printing section prime motor 142 to compute the torque rate of the offset printing section prime motor 142, which is stored into the memory M114. Then, in Step P82, the torque distribution rate of the intaglio printing section auxiliary motor 148 is loaded from the memory M101.

Then, in Step P83, the torque rate of the offset printing section prime motor 142 is multiplied by the torque distribution rate of the intaglio printing section auxiliary motor 148 to compute the torque rate of the intaglio printing section auxiliary motor 148, which is stored into the memory M115. Then, in Step P84, the rated electric current value of the intaglio printing section auxiliary motor 148 is loaded from the memory M116.

Then, in Step P85, the torque rate of the intaglio printing section auxiliary motor 148 is multiplied by the rated electric current value of the intaglio printing section auxiliary motor 148 to compute the electric current value (driving torque value) of the intaglio printing section auxiliary motor 148, which is stored into the memory M117. Then, in Step P86, a torque control command and the electric current value (driving torque value) of the intaglio printing section auxiliary motor 148 are outputted to the intaglio printing section auxiliary motor driver 147, and the program returns to Step P53.

In accordance with the above-described operational or action flow, even during speed reduction of the sheet-fed printing press 10, speed switching control, and torque control of the intaglio printing section auxiliary motor 148, which are similar to those at constant speed or during speed acceleration, are exercised.

Then, in Step P87 to which the program has shifted from the aforementioned Step P7, it is determined whether a set rotational speed has been inputted to the rotational speed setting unit 132 for offset printing section independent drive. If the answer is Y, in Step P88, the rotational speed for offset printing section independent drive is loaded from the rotational speed setting unit 132 for offset printing section independent drive, and stored into the memory M119. Then, the program shifts to Step P89. If the answer is N in Step P87, the program directly shifts to Step P89.

Then, in Step P89, it is determined whether a set rotational speed has been inputted to the rotational speed setting unit 133 for intaglio printing section independent drive. If the answer is Y, in Step P90, the rotational speed for intaglio printing section independent drive is loaded from the rotational speed setting unit 133 for intaglio printing section independent drive, and stored into the memory M120. Then, the program shifts to Step P91. If the answer is N in Step P89, the program directly shifts to Step P91.

Then, in Step P91, it is determined whether a set rotational speed has been inputted to the rotational speed setting unit 134 for wiping roll independent drive. If the answer is Y, in Step P92, the rotational speed for wiping roll independent drive is loaded from the rotational speed setting unit 134 for wiping roll independent drive, and stored into the memory M121. Then, the program shifts to Step P93. If the answer is N in Step P91, the program directly shifts to Step P93.

Then, in Step P93, it is determined whether the offset printing section independent drive switch 122 has been turned on. If the answer is Y, a connection release signal is outputted to the printing section connecting clutch 156 in Step P94. If the answer is N, the program shifts to Step P97 to be described later.

Then, in Step P95, the rotational speed for offset printing section independent drive is loaded from the memory M119. Then, in Step P96, a speed control command and the rotational speed for offset printing section independent drive are outputted to the offset printing section prime motor driver 141.

Then, in the above-mentioned Step P97, it is determined whether the intaglio printing section independent drive switch 124 has been turned on. If the answer is Y, a connection release signal is outputted to the printing section connecting clutch 156 in Step P98. If the answer is N in Step P97, the program shifts to Step P101 to be described later.

Then, in Step P99, the rotational speed for intaglio printing section independent drive is loaded from the memory M120. Then, in Step P100, a speed control command and the rotational speed for intaglio printing section independent drive are outputted to the intaglio printing section auxiliary motor driver 147.

Then, in the above-mentioned Step P101, it is determined whether the wiping roll independent drive switch 126 has been turned on. If the answer is Y, the rotational speed for wiping roll independent drive is loaded from the memory M121 in Step P102. Then, the program shifts to Step P103. If the answer is N in Step P103, the program shifts to Step P104 to be described later.

Then, in Step P103, a speed control command and the rotational speed for wiping roll independent drive are outputted to the wiping roll drive motor driver 151. Then, in the above Step P104, it is determined whether the offset printing section independent drive stop switch 123 has been turned on.

If the answer is Y in the above Step P104, a stop command is outputted to the offset printing section prime motor driver 141 in Step P105. Then, the program shifts to Step P106. If the answer is Y in Step P104, the program shifts directly to Step P106.

Then, in Step P106, it is determined whether the intaglio printing section independent drive stop switch 125 has been turned on. If the answer is Y, a stop command is outputted to the intaglio printing section auxiliary motor driver 147 in Step P107. Then, the program shifts to Step P108. If the answer is N in Step P106, the program shifts directly to Step P108.

Then, in Step P108, it is determined whether the wiping roll independent drive stop switch 127 has been turned on. If the answer is Y, a stop command is outputted to the wiping roll drive motor driver 151 in Step P109. Then, the program shifts to Step P110. If the answer is N in Step P108, the program shifts directly to Step P110.

Then, in the above Step P110, it is determined whether a stop command is being outputted to the offset printing section prime motor driver 141, the intaglio printing section auxiliary motor driver 147, and the wiping roll drive motor driver 151. If the answer is Y, the program returns to Step P1. If the answer is N, the program returns to Step P87.

In accordance with the above-described operational or action flow, the offset printing section prime motor 142, the intaglio printing section auxiliary motor 148, and the wiping roll drive motor 152 are individually controlled to be rotationally driven, whereby the independent drive of each printing section is carried out. The speed control command issued to each motor driver in the above embodiment refers to a command to control each motor so as to be driven at the outputted rotational speed. The torque control command issued to each motor driver refers to a command to control each motor to be driven with the outputted torque.

In the present embodiment, as described above, the offset printing section 20 and the intaglio printing section 30 are coupled together by the gear train. Separately from the offset printing section prime motor 142 for driving the entire sheet-fed printing press 10, the intaglio printing section auxiliary motor 148 is provided in the intaglio printing section 30 where the load is heaviest and load variations are great. By so doing, the sheet-fed printing press 10 as a whole is driven by the offset printing section prime motor 142 and the intaglio printing section auxiliary motor 148. Moreover, the electric current value (driving torque value) of the intaglio printing section auxiliary motor 148 is controlled in accordance with the electric current value (torque value) for driving the offset printing section prime motor 142, the torque distribution rate of the intaglio printing section auxiliary motor 148, and the rated electric current value of the intaglio printing section auxiliary motor 148.

Because of these features, the driving torque distribution rate of the intaglio printing section auxiliary motor 148 during printing can be set appropriately according to load variations of the intaglio printing section 30. Thus, the low capacity of the offset printing section prime motor 142 can be achieved. As a result, the drive system of the sheet-fed printing press 10 can be downsized to make cost reduction and high speed printing possible.

In the present embodiment, moreover, the electric current value display unit 137 for the wiping roll drive motor and the electric current value difference display unit 138 for the wiping roll drive motor are provided. Thus, an operator can adjust the torque on the intaglio printing section auxiliary motor 148 based on the load on the wiping roll drive motor 152 displayed on these display units 137, 138. That is, torque control over the intaglio printing section auxiliary motor 148 can be exercised semiautomatically.

With the printing section connecting clutch 156 being released from connection, the offset printing section 20 and the intaglio printing section 30 can be independently driven by the offset printing section prime motor 142 and the intaglio printing section auxiliary motor 148, respectively. In the respective printing sections 20 and 30, therefore, printing preparation operations such as blanket washing and inker washing can be performed individually. On this occasion, gripper release mechanisms (see the aforementioned annular groove 50 and the dimension L) for the many grippers 47*a*, 49*a* in the aforementioned gripper devices 47, 49 provided between the last transfer cylinder 23*e* of the offset printing section 20 and the first transfer cylinder 23*f* of the intaglio printing section 30 enable the offset printing section 20 and the intaglio printing section 30 to be independently driven without hindrance.

Embodiment 2

Figure 9A:
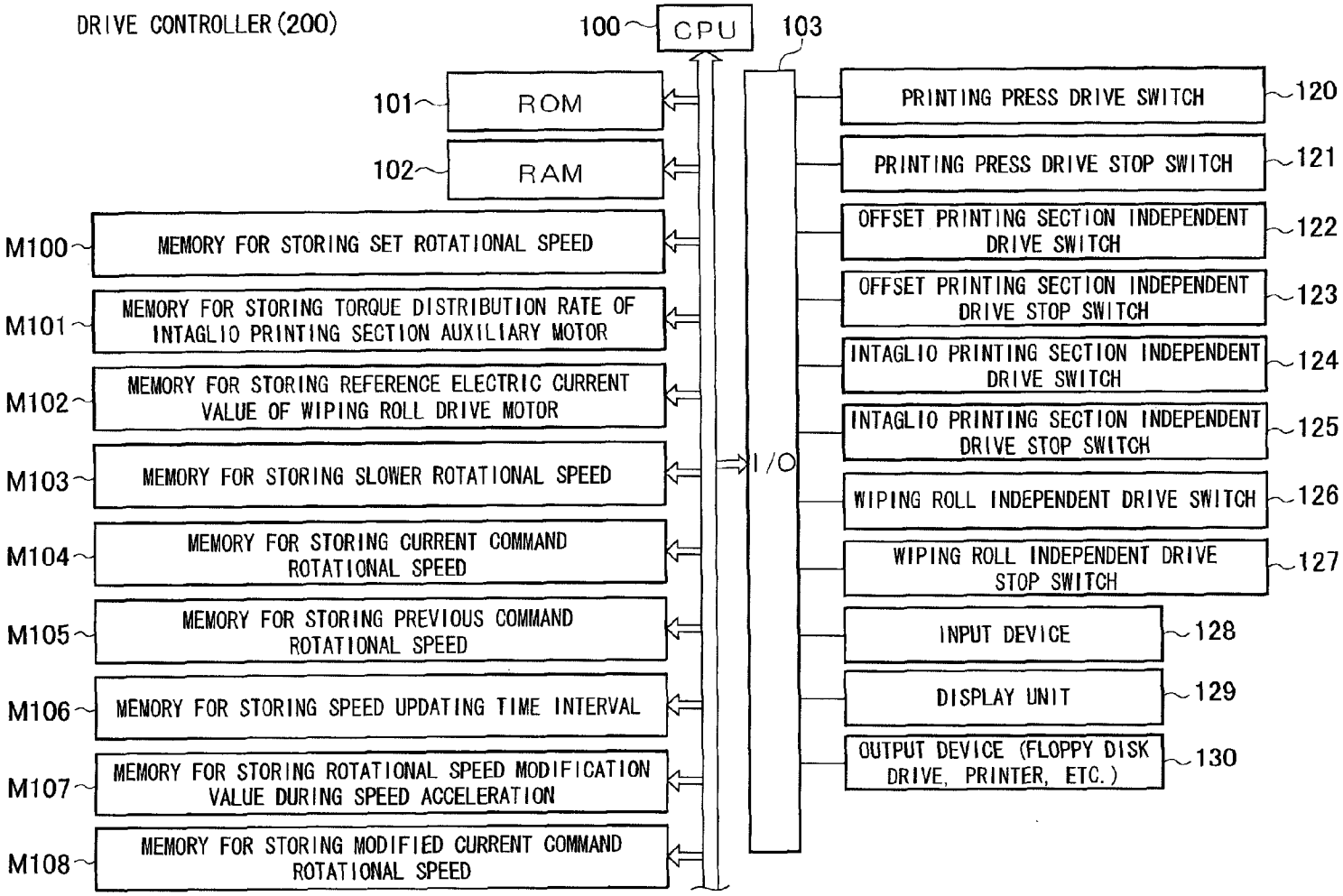
FIG. 9A is a hardware block diagram of a drive control apparatus for an offset printing section and an intaglio printing section in Embodiment 2 of the present invention.
Figure 9B:
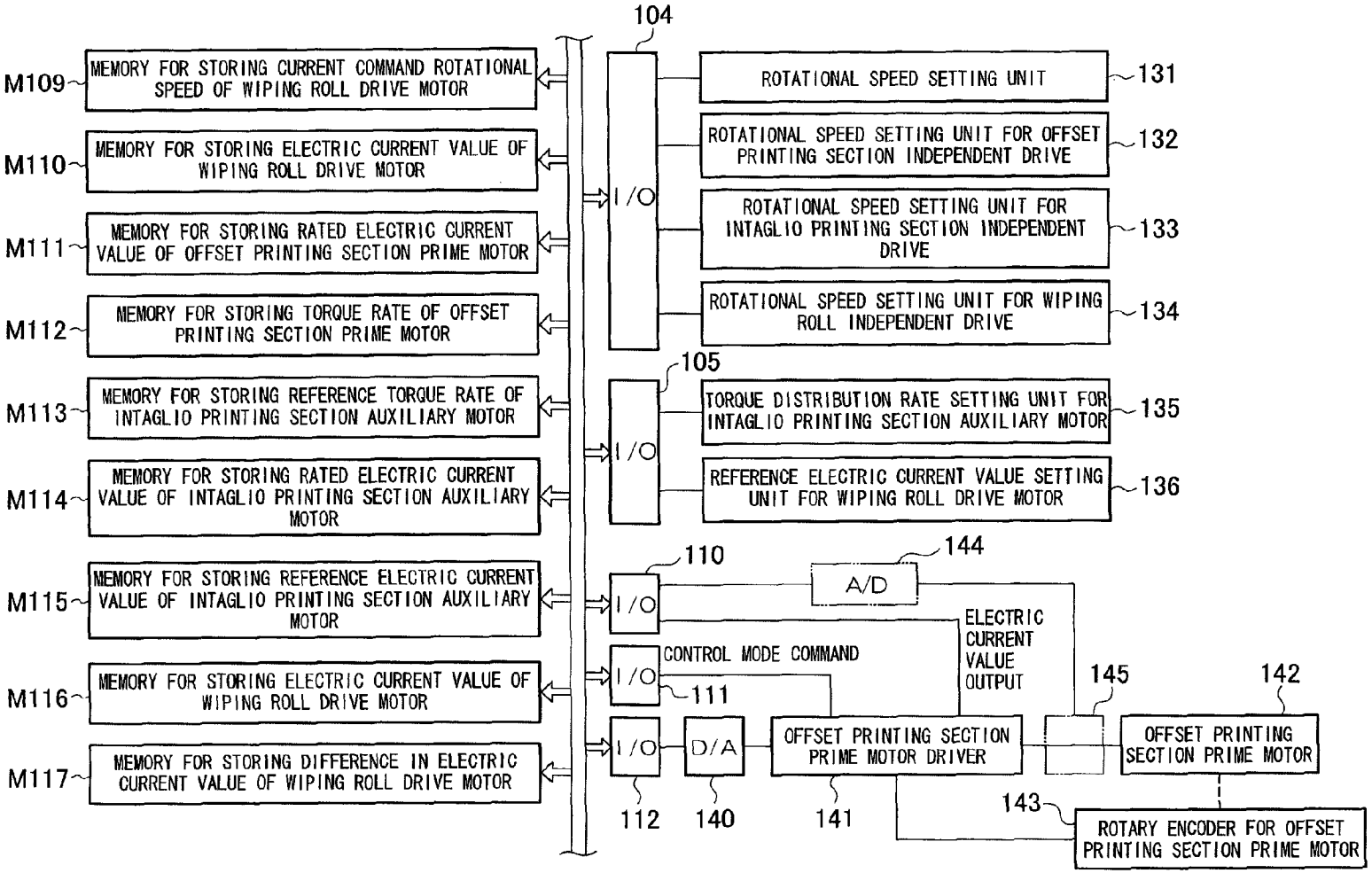
FIG. 9B is a hardware block diagram of the drive control apparatus for the offset printing section and the intaglio printing section in Embodiment 2 of the present invention.
Figure 9C:
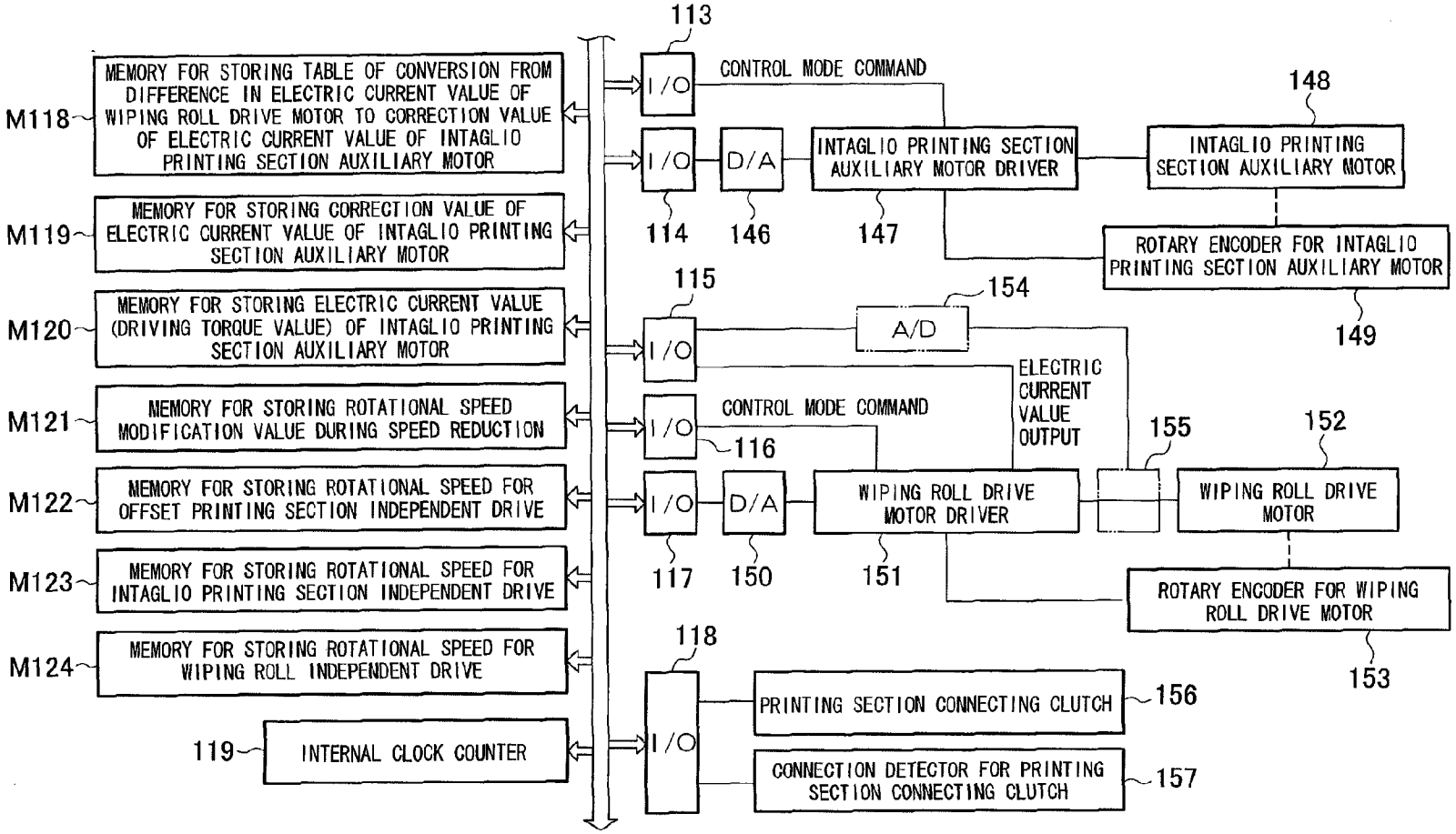
FIG. 9C is a hardware block diagram of the drive control apparatus for the offset printing section and the intaglio printing section in Embodiment 2 of the present invention.
Figure 10A:
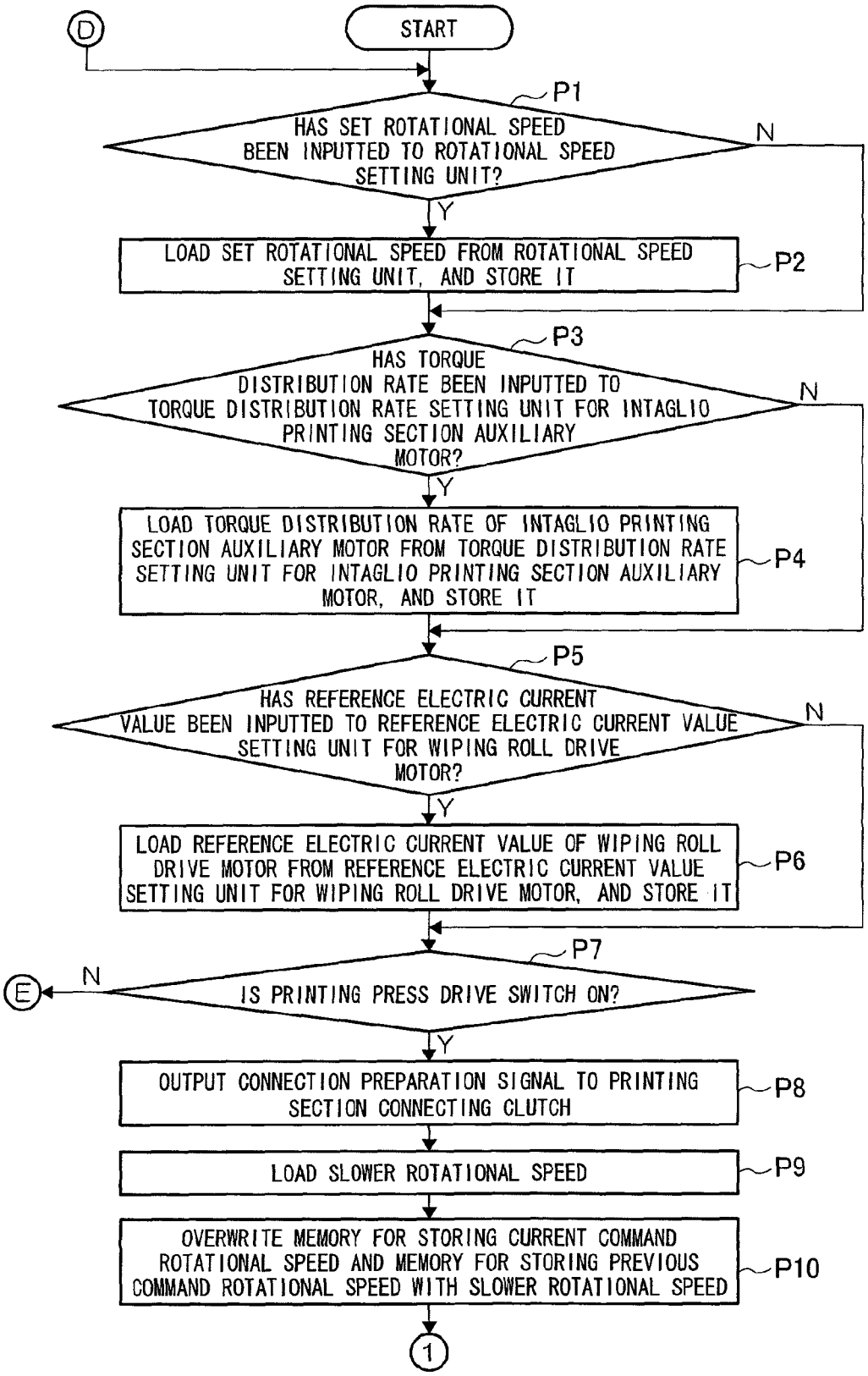
FIG. 10A is an action flow chart of the drive control apparatus for the offset printing section and the intaglio printing section in Embodiment 2 of the present invention.
Figure 10B:
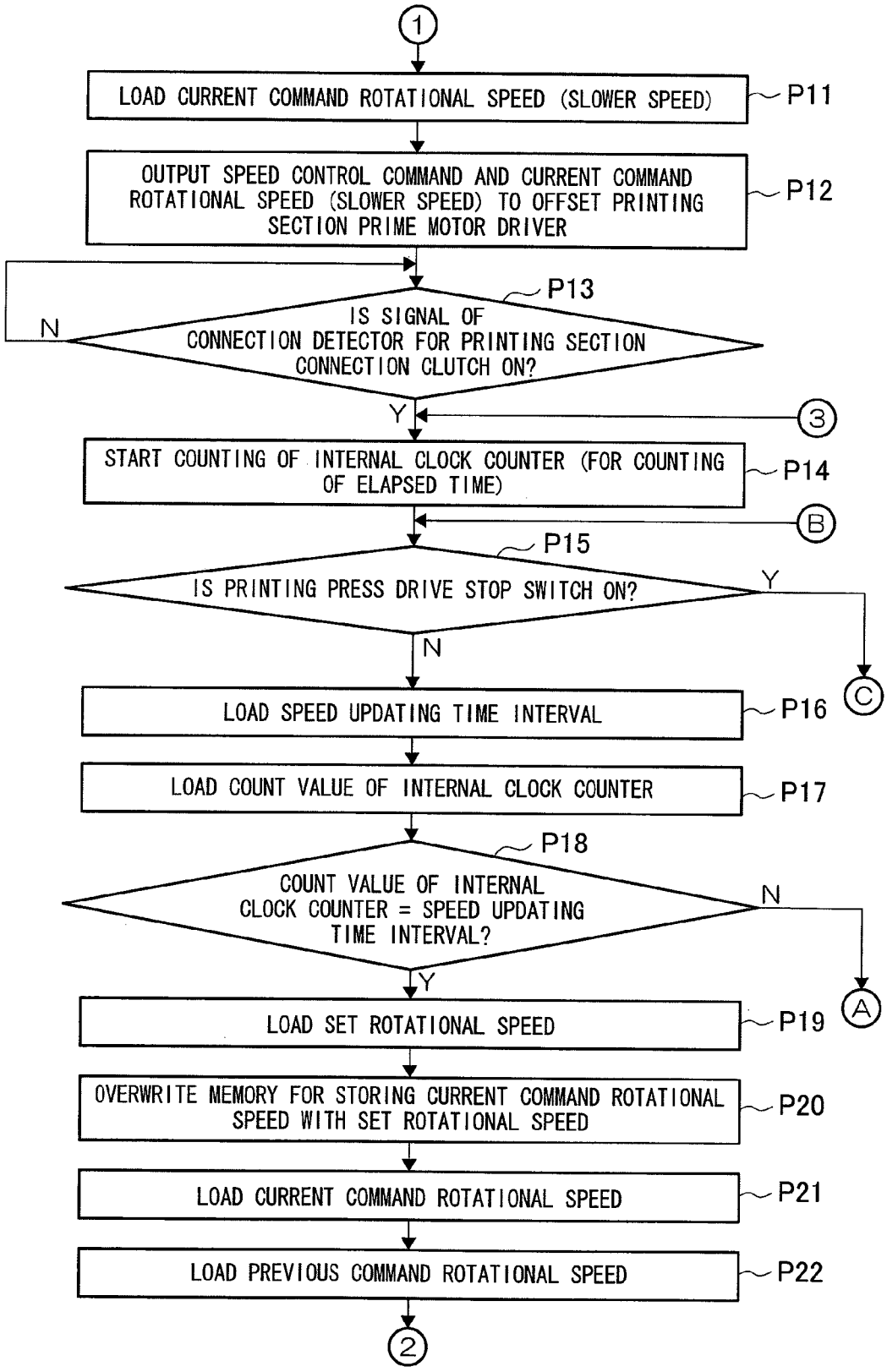
FIG. 10B is an action flow chart of the drive control apparatus for the offset printing section and the intaglio printing section in Embodiment 2 of the present invention.
Figure 10C:
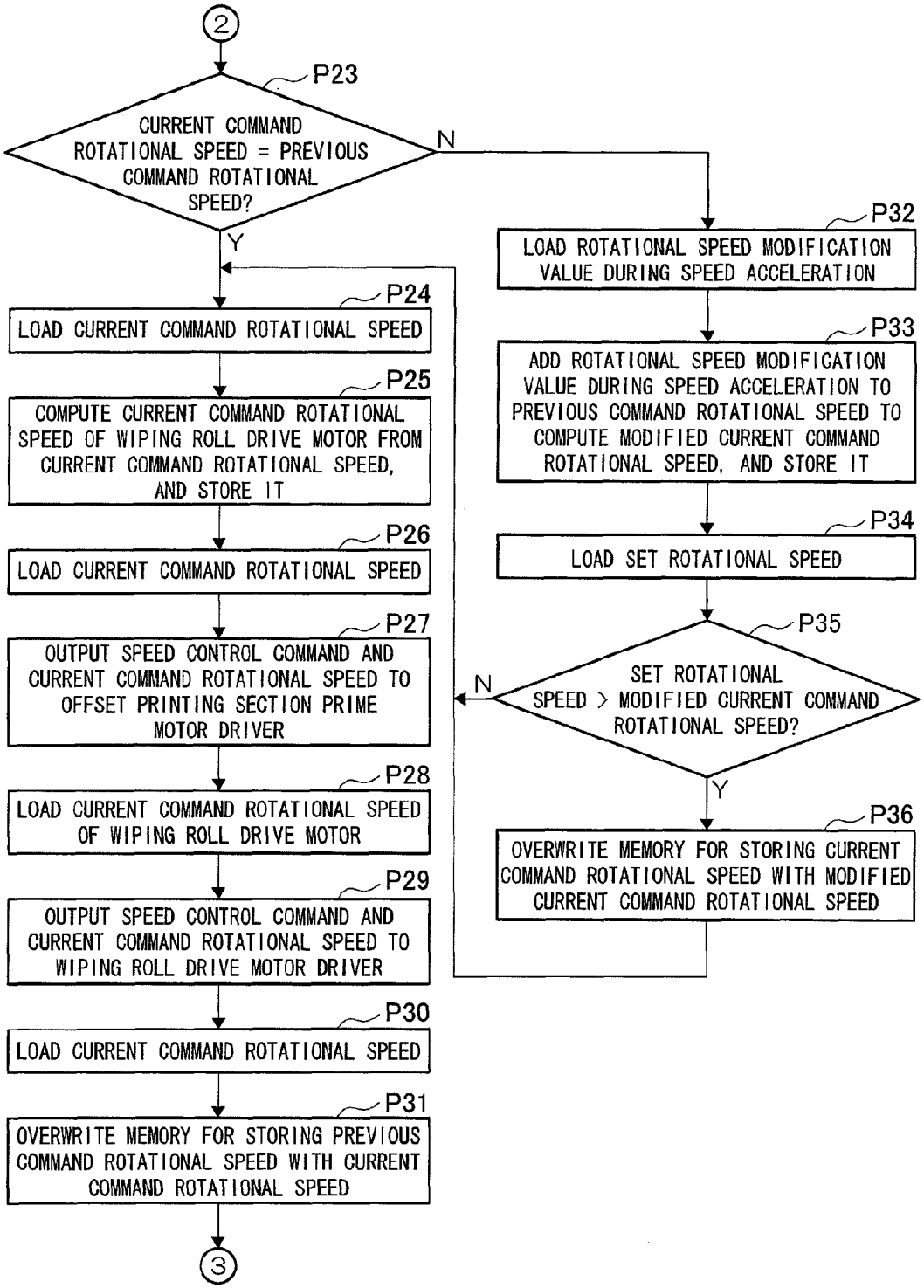
FIG. 10C is an action flow chart of the drive control apparatus for the offset printing section and the intaglio printing section in Embodiment 2 of the present invention.
Figure 11:
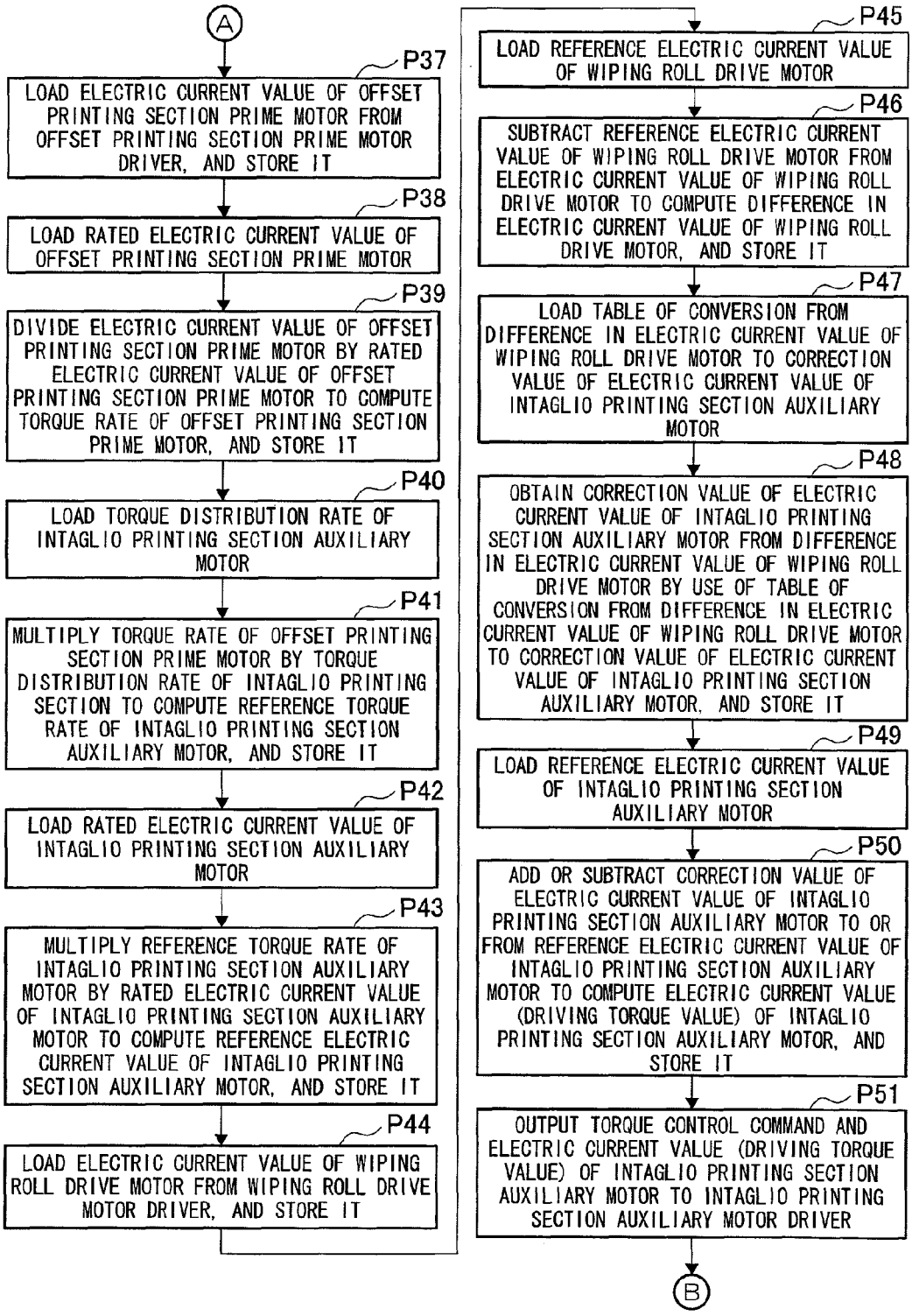
FIG. 11 is an action flow chart of the drive control apparatus for the offset printing section and the intaglio printing section in Embodiment 2 of the present invention.
Figure 12A:
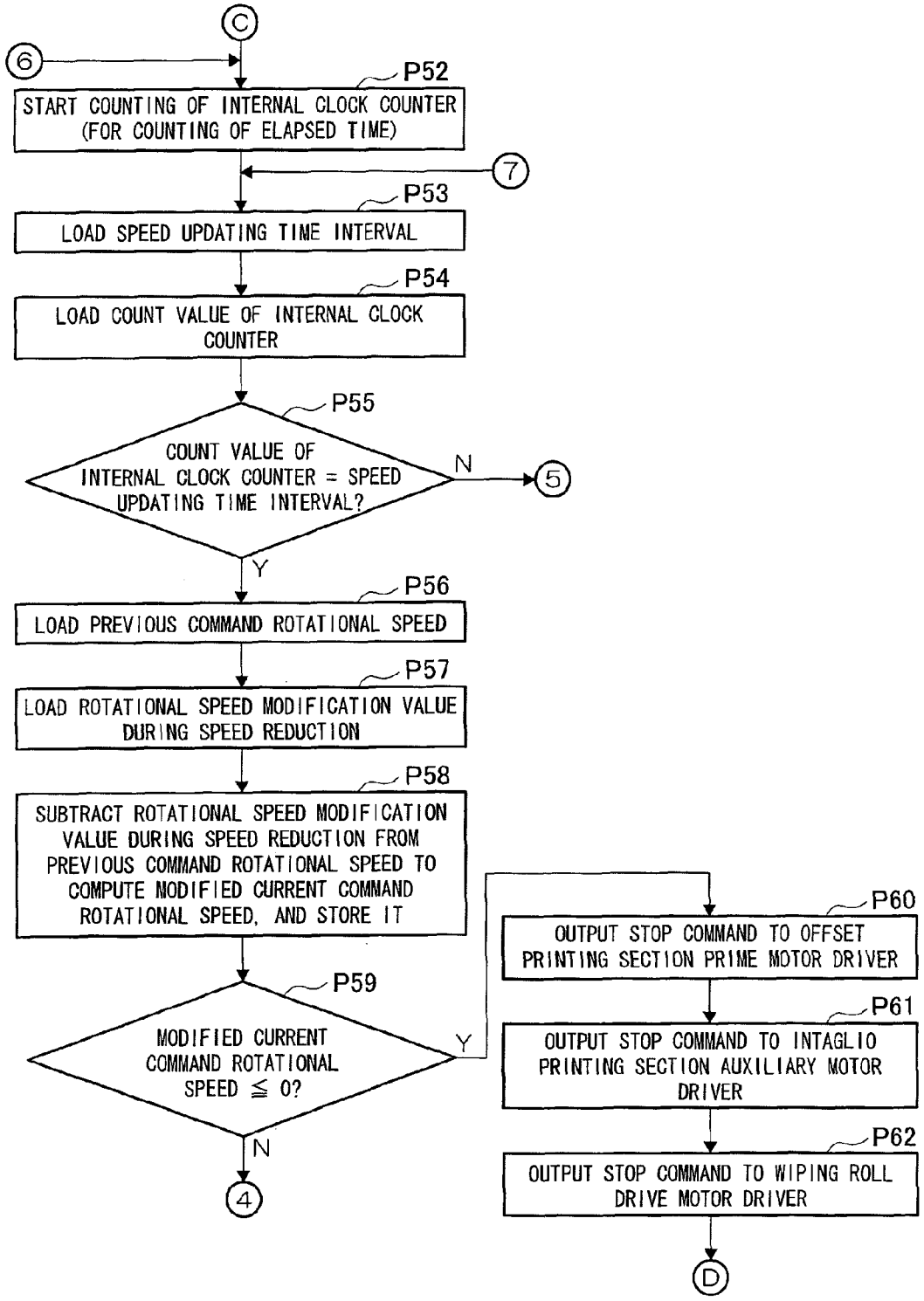
FIG. 12A is an action flow chart of the drive control apparatus for the offset printing section and the intaglio printing section in Embodiment 2 of the present invention.
Figure 12B:
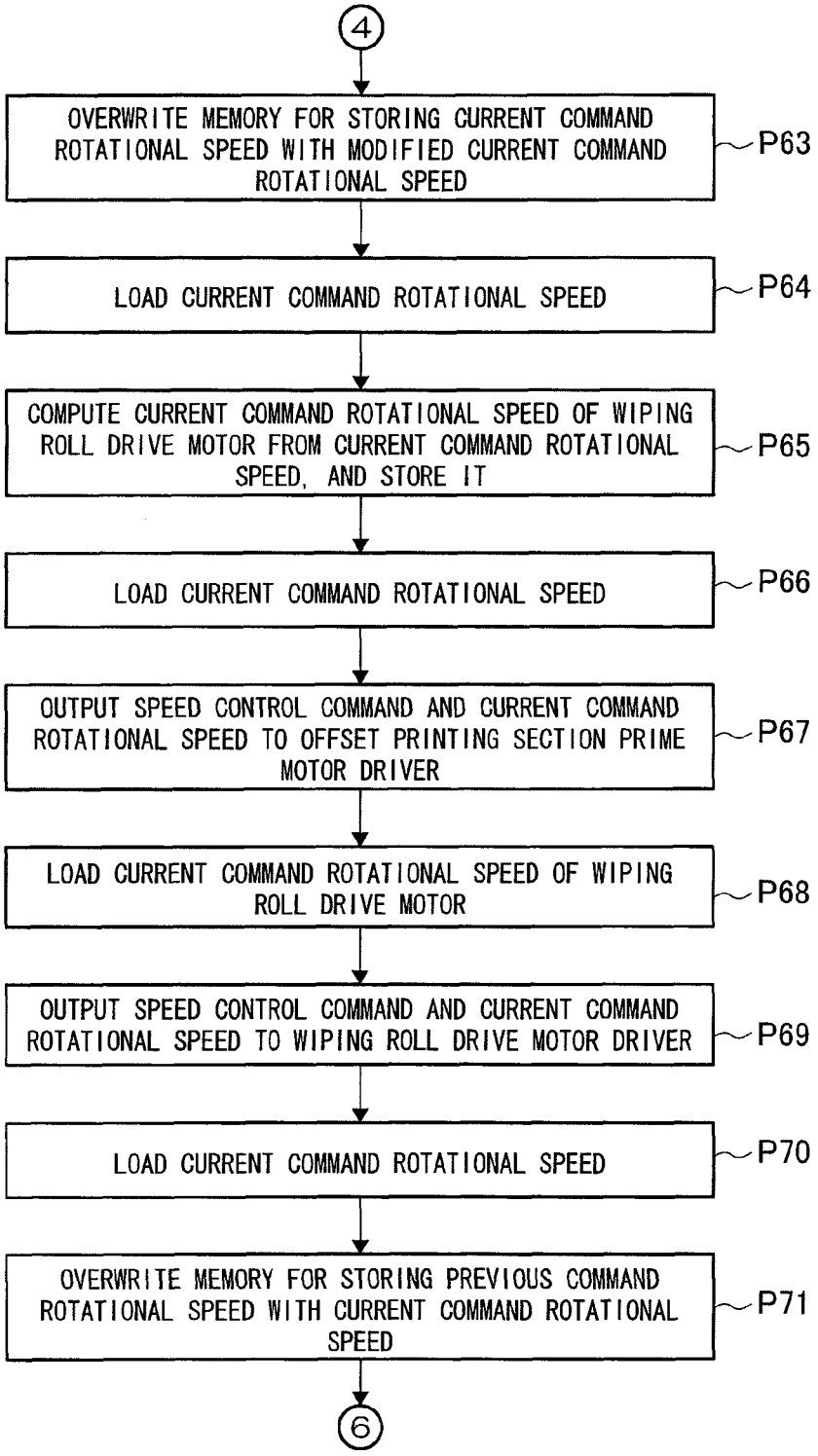
FIG. 12B is an action flow chart of the drive control apparatus for the offset printing section and the intaglio printing section in Embodiment 2 of the present invention.
Figure 12C:
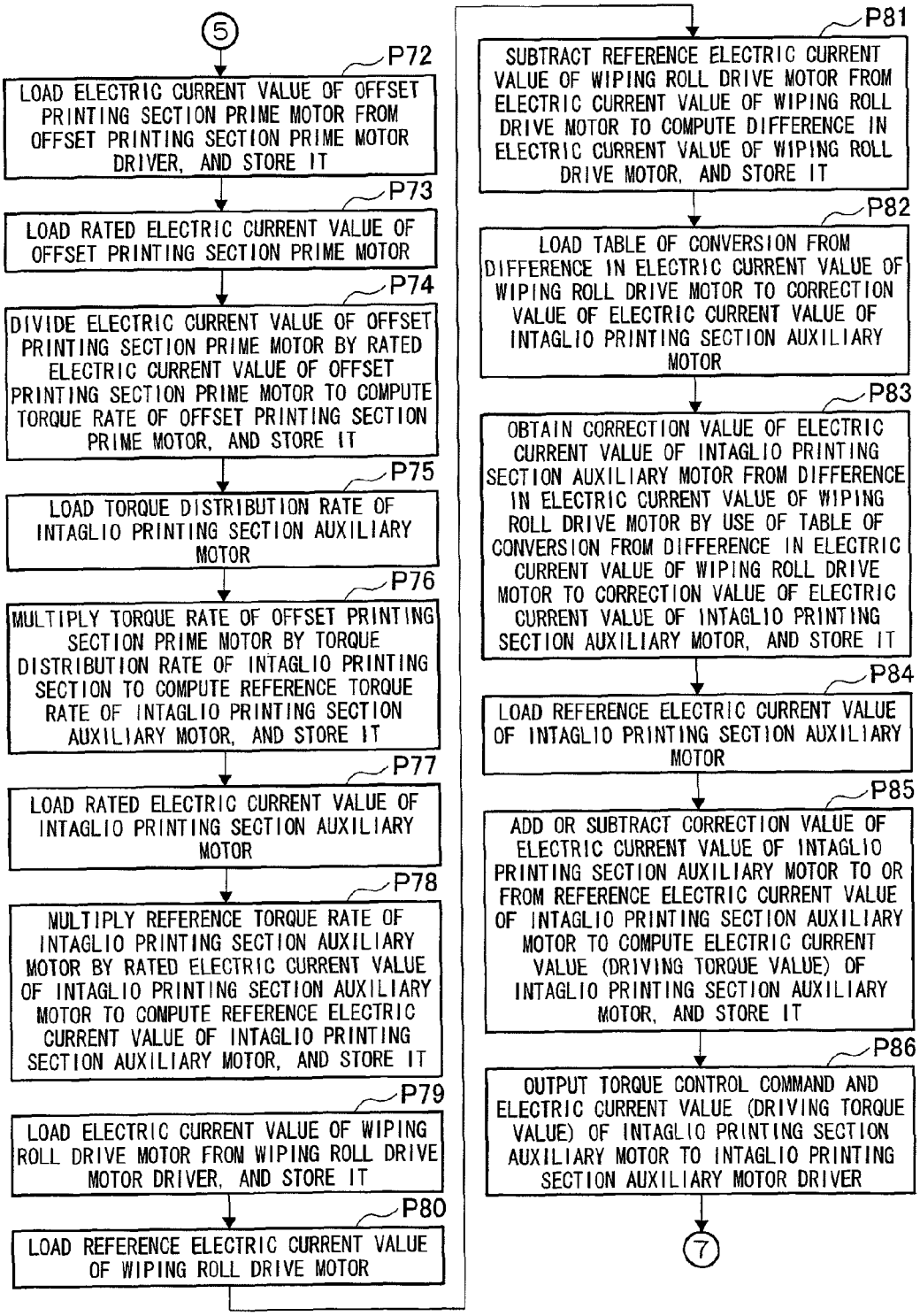
FIG. 12C is an action flow chart of the drive control apparatus for the offset printing section and the intaglio printing section in Embodiment 2 of the present invention.
Figure 13A:
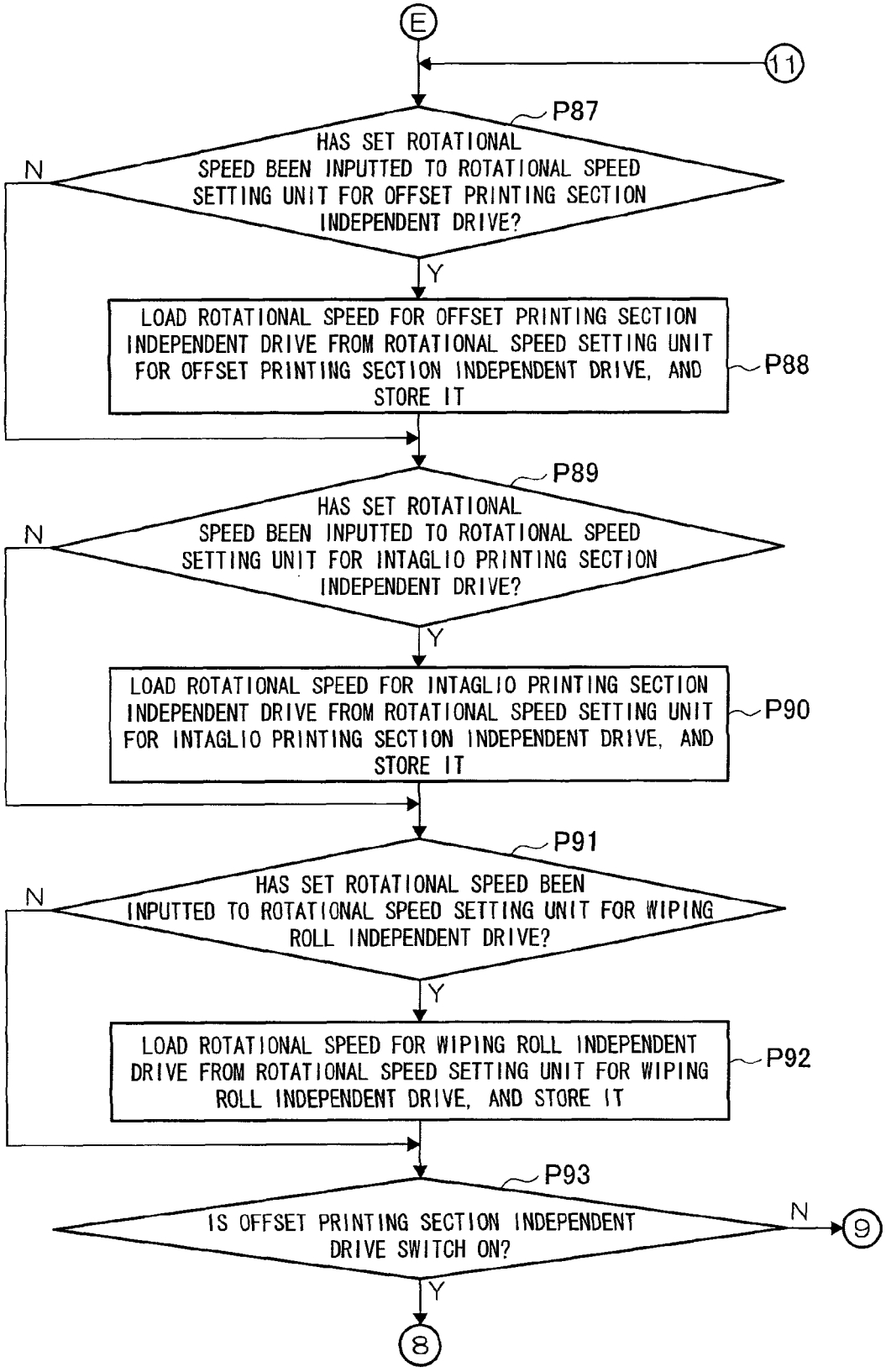
FIG. 13A is an action flow chart of the drive control apparatus for the offset printing section and the intaglio printing section in Embodiment 2 of the present invention.
Figure 13B:
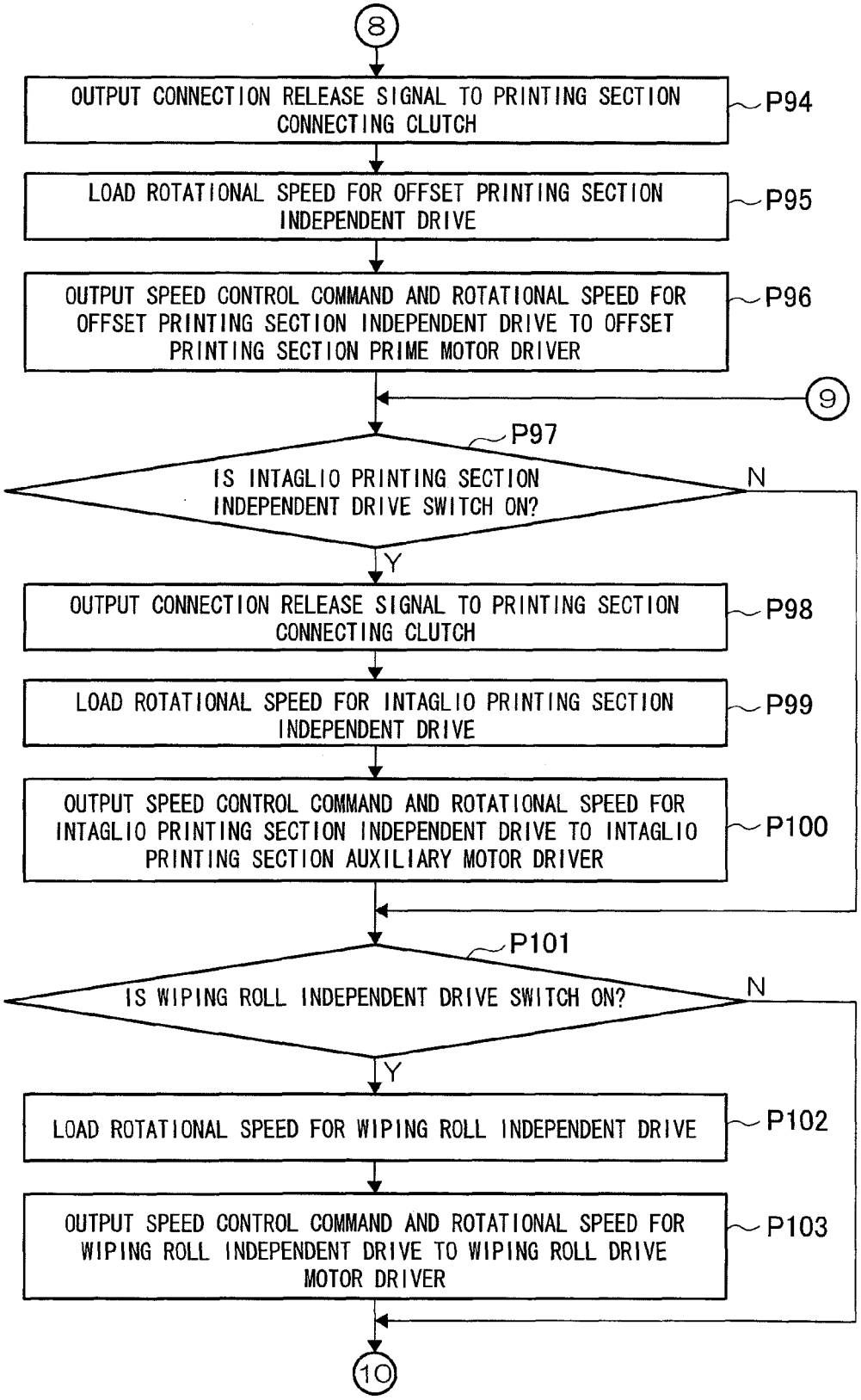
FIG. 13B is an action flow chart of the drive control apparatus for the offset printing section and the intaglio printing section in Embodiment 2 of the present invention.
Figure 13C:
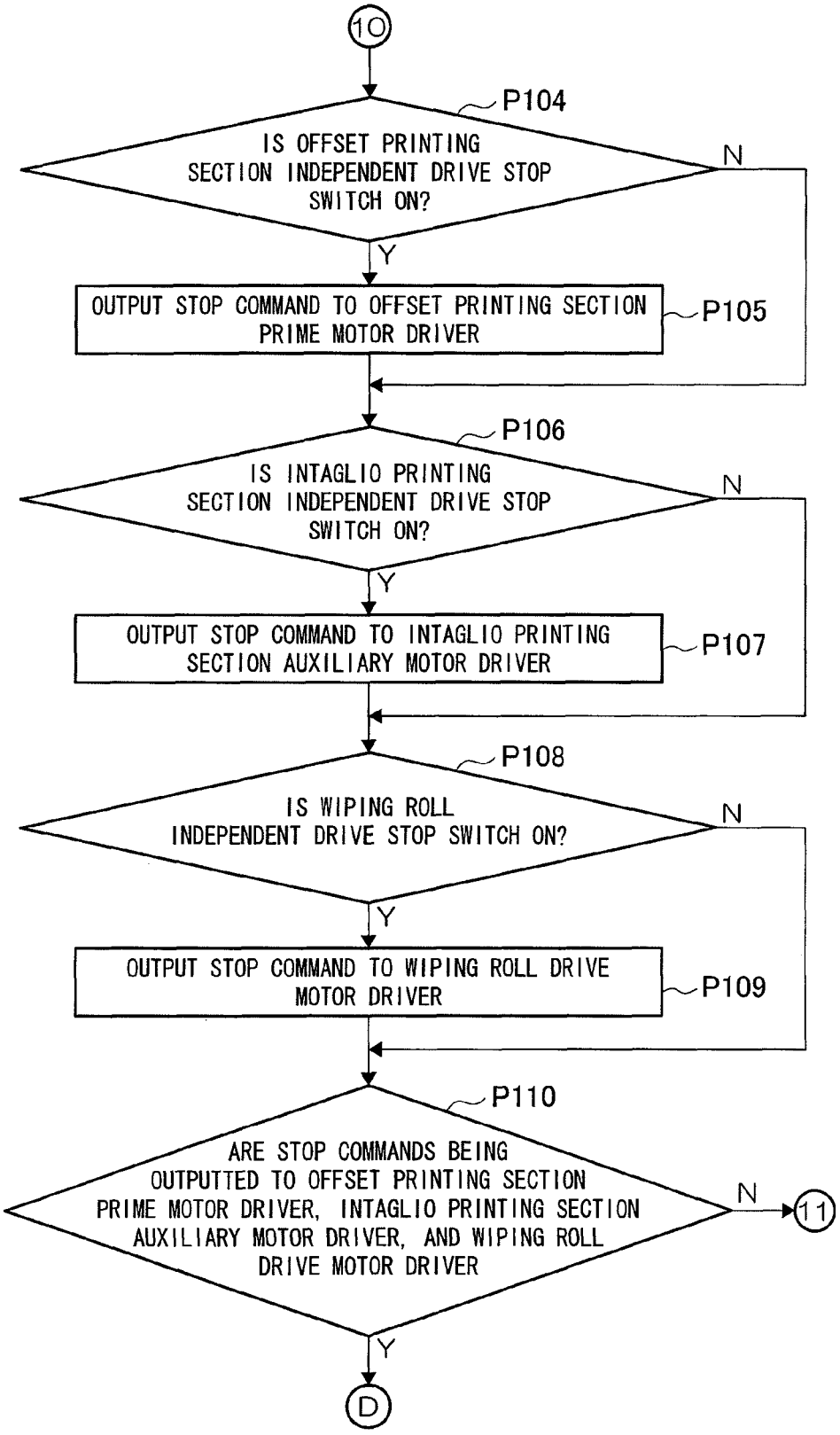
FIG. 13C is an action flow chart of the drive control apparatus for the offset printing section and the intaglio printing section in Embodiment 2 of the present invention.

FIGS. 9A to 9C are hardware block diagrams of a drive control apparatus for an offset printing section and an intaglio printing section in Embodiment 2 of the present invention.

FIGS. 10A to 10C, FIG. 11, FIGS. 12A to 12C, and FIGS. 13A to 13C are action flow charts of the drive control apparatus for the offset printing section and the intaglio printing section in Embodiment 2 of the present invention.

The schematic configuration of the sheet-fed printing press, the configuration of the gear train of the sheet-fed printing press, and the configuration between the transfer cylinders in the offset printing section and the intaglio printing section of the sheet-fed printing press are the same as those in FIGS. 6, 7 and 8 of Embodiment 1. Thus, reference to them is to be made, and duplicate explanations will be omitted.

As shown in FIGS. 9A to 9C, a drive controller 200 is composed of CPU 100, ROM 101, RAM 102, input/output devices 103 to 105, 110 to 118, and an internal clock counter 119 which are interconnected by BUS (bus line).

To the BUS, the following memories are connected: a memory M100 for storing a set rotational speed; a memory M101 for storing the torque distribution rate of the intaglio printing section auxiliary motor; a memory M102 for storing the reference electric current value of the wiping roll drive motor; a memory M103 for storing a slower rotational speed; a memory M104 for storing a current command rotational speed; a memory M105 for storing a previous command rotational speed; a memory M106 for storing a speed updating time interval; and a memory M107 for storing a rotational speed modification value during speed acceleration.

To the BUS, the following memories are also connected: a memory M108 for storing a modified current command rotational speed; a memory M109 for storing the current command rotational speed of the wiping roll drive motor; a memory M110 for storing the electric current value of the offset printing section prime motor; a memory M111 for storing the rated electric current value of the offset printing section prime motor; a memory M112 for storing the torque rate of the offset printing section prime motor; a memory M113 for storing the reference torque rate of the intaglio printing section auxiliary motor; a memory M114 for storing the rated electric current value of the intaglio printing section auxiliary motor; and a memory M115 for storing the reference electric current value of the intaglio printing section auxiliary motor.

To the BUS, the following memories are further connected: a memory M116 for storing the electric current value of the wiping roll drive motor; a memory M117 for storing a difference in the electric current value of the wiping roll drive motor; a memory M118 for storing a table of conversion from the difference in the electric current value of the wiping roll drive motor to the correction value of the electric current value of the intaglio printing section auxiliary motor; a memory M119 for storing the correction value of the electric current value of the intaglio printing section auxiliary motor; a memory M120 for storing the electric current value (driving torque value) of the intaglio printing section auxiliary motor; a memory M121 for storing a rotational speed modification value during speed reduction; a memory M122 for storing a rotational speed for offset printing section independent drive; a memory M123 for storing a rotational speed for intaglio printing section independent drive; and a memory M124 for storing a rotational speed for wiping roll independent drive.

To the input/output device 103, the following are further connected: a printing press drive switch 120; a printing press drive stop switch 121; an offset printing section independent drive switch 122; an offset printing section independent drive stop switch 123; an intaglio printing section independent drive switch 124; an intaglio printing section independent drive stop switch 125; a wiping roll independent drive switch 126; a wiping roll independent drive stop switch 127; an input device 128 including a keyboard, various switches, buttons, and the like; a display unit 129 including CRT, lamps and the like; and an output device 130 including a floppy (registered trademark) disk drive, a printer, and the like.

To the input/output device 104, the following are connected: a rotational speed setting unit 131; a rotational speed setting unit 132 for offset printing section independent drive; a rotational speed setting unit 133 for intaglio printing section independent drive; and a rotational speed setting unit 134 for wiping roll independent drive.

To the input/output device 105, a torque distribution rate setting unit 135 for the intaglio printing section auxiliary motor, and a reference electric current value setting unit 136 for the wiping roll drive motor are connected.

The input/output device 110 is connected to an offset printing section prime motor driver 141 to receive, as an input, an electric current value (torque value) outputted from the offset printing section prime motor driver 141. On this occasion, an electric current value (torque value) may be entered into the input/output device 110 from an ammeter 145, which is provided separately from the offset printing section prime motor driver 141, via an A/D converter 144.

The input/output device 111 is connected to the offset printing section prime motor driver 141 to output a control mode command to the offset printing section prime motor driver 141.

The input/output device 112 is connected to an offset printing section prime motor 142 via a D/A converter 140 and the above-mentioned offset printing section prime motor driver 141. The offset printing section prime motor driver 141 receives, as an input, a rotation rate (i.e., number of revolutions) signal from a rotary encoder 143 for the offset printing section prime motor which is connectedly driven by the offset printing section prime motor 142.

The input/output device 113 is connected to an intaglio printing section auxiliary motor driver 147 to output a control mode command to the intaglio printing section auxiliary motor driver 147.

The input/output device 114 is connected to an intaglio printing section auxiliary motor 148 via a D/A converter 146 and the above-mentioned intaglio printing section auxiliary motor driver 147. The intaglio printing section auxiliary motor driver 147 receives, as an input, a rotation rate signal from a rotary encoder 149 for the intaglio printing section auxiliary motor which is connectedly driven by the intaglio printing section auxiliary motor 148.

The input/output device 115 is connected to a wiping roll drive motor driver 151 to receive, as an input, an electric current value (torque value) outputted by the wiping roll drive motor driver 151. To the input/output device 115, an electric current value (torque value) may be inputted via an A/D converter 154 from an ammeter 155 provided separately from the wiping roll drive motor driver 151.

The input/output device 116 is connected to the wiping roll drive motor driver 151 to output a control mode command to the wiping roll drive motor driver 151.

The input/output device 117 is connected to a wiping roll drive motor 152 via a D/A converter 150 and the above-mentioned wiping roll drive motor driver 151. The wiping roll drive motor driver 151 receives, as an input, a rotation rate signal from a rotary encoder 153 for the wiping roll drive motor which is connectedly driven by the wiping roll drive motor 152.

To the input/output device 118, a printing section connecting clutch 156 and a connection detector 157 for the printing section connecting clutch are connected.

The actions of the drive controller 200 for the offset printing section and the intaglio printing section, which have been described above, will be described below.

The drive controller 200 operates in accordance with an action or operational flow shown in FIGS. 10A to 10C, FIG. 11, FIGS. 12A to 12C, and FIGS. 13A to 13C.

In Step P1, it is determined whether a set rotational speed has been inputted to the rotational speed setting unit 131. If the answer is yes (Y), in Step P2, the set rotational speed is loaded from the rotational speed setting unit 131, and stored into the memory M100. Then, the program shifts to Step P3. If the answer is no (N) in Step P1, the program directly shifts to Step P3.

Then, in Step P3, it is determined whether a torque distribution rate has been inputted to the torque distribution rate setting unit 135 for the intaglio printing section auxiliary motor. If the answer is Y, in Step P4, the torque distribution rate of the intaglio printing section auxiliary motor 148 is loaded from the torque distribution rate setting unit 135 for the intaglio printing section auxiliary motor, and stored into the memory M101. Then, the program shifts to Step P5. If the answer is N in Step P3, the program directly shifts to Step P5.

Then, it is determined in Step P5 whether a reference electric current value has been inputted to the reference electric current value setting unit 136 for the wiping roll drive motor. If the answer is Y, in Step P6, the reference electric current value of the wiping roll drive motor 152 is loaded from the reference electric current value setting unit 136 for the wiping roll drive motor, and stored into the memory M102. Then, the program shifts to Step P7. If the answer is N in Step P5, the program directly shifts to Step P7.

Then, in Step P7, it is determined whether the printing press drive switch 120 has been turned on. If the answer is Y, a connection preparation signal is outputted to the printing section connecting clutch 156 in Step P8. Then, the program shifts to Step P9. If the answer is N in Step P7, the program shifts to Step P87 to be described later.

Then, in Step P9, a slower rotational speed is loaded from the memory M703. In Step P10, the memory M104 for storing a current command rotational speed and the memory M105 for storing a previous command rotational speed are overwritten with the slower rotational speed. Then, in Step P11, the current command rotational speed (slower speed) is loaded from the memory M104.

Then, in Step P12, a speed control command and the current command rotational speed (slower speed) are outputted to the offset printing section prime motor driver 141. Then, in Step P13, it is determined whether the signal of the connection detector 157 for the printing section connecting clutch is ON. If the answer is Y in Step P13, counting of the internal clock counter (for counting of the elapsed time) 119 is started in Step P14.

Then, in Step P15, it is determined whether the printing press drive stop switch 121 has been turned on. If the answer is Y, the program shifts to Step P52 to be described later. If the answer is N, a speed updating time interval is loaded from the memory M106 in Step P16. Then, in Step P17, the count value of the internal clock counter 119 is loaded.

Then, in Step P18, it is determined whether the count value of the internal clock counter is equal to the speed updating time interval. If the answer is Y, the set rotational speed is loaded from the memory M100 in Step P19. Then, the program shifts to Step P20. If the answer is N in Step P18, the program shifts to Step P37 to be described later.

Then, in Step P20, the memory M104 for storing the current command rotational speed is overwritten with the set rotational speed. Then, in Step P21, the current command rotational speed is loaded from the memory M104. In Step P22, the previous command rotational speed is loaded from the memory M105.

Then, in Step P23, it is determined whether the current command rotational speed is equal to the previous command rotational speed. If the answer is Y, the current command rotational speed is loaded from the memory M104 in Step P24. Then, in Step P25, the current command rotational speed of the wiping roll drive motor 152 is computed from the current command rotational speed, and stored into the memory M109. The current command rotational speed of the wiping roll drive motor 152 is obtained by multiplying the current command rotational speed by a predetermined coefficient.

Then, in Step P26, the current command rotational speed is loaded from the memory M104. Then, in Step P27, a speed control command and the current command rotational speed are outputted to the offset printing section prime motor driver 141.

Then, in Step P28, the current command rotational speed of the wiping roll drive motor 152 is loaded from the memory M109. Then, in Step P29, a speed control command and the current command rotational speed are outputted to the wiping roll drive motor driver 151.

Then, in Step P30, the current command rotational speed is loaded from the memory M104. Then, in Step P31, the memory M105 for storing the previous command rotational speed is overwritten with the current command rotational speed. Then, the program returns to Step P14.

If the answer is N in Step P23, on the other hand, a rotational speed modification value during speed acceleration is loaded from the memory M107 in Step P32. Then, in Step P33, the rotational speed modification value during speed acceleration is added to the previous command rotational speed to compute a modified current command rotational speed, which is stored into the memory M108.

Then, in step P34, the set rotational speed is loaded from the memory M100. Then, in Step P35, it is determined whether the set rotational speed is higher than the modified current command rotational speed. If the answer is Y, in Step P36, the memory M104 for storing the current command rotational speed is overwritten with the modified current command rotational speed. Then, the program shifts to Step P24. If the answer is N in Step P35, the program directly shifts to Step P24.

In accordance with the above-described operational or action flow, the speed switching control of the sheet-fed printing press 10, namely, the offset printing section prime motor 142 (and the intaglio printing section auxiliary motor 148) and the wiping roll drive motor 152, takes place.

Then, in Step P37 to which the program has shifted from the aforementioned Step P18, the electric current value of the offset printing section prime motor 142 is loaded from the offset printing section prime motor driver 141, and stored into the memory M110. Then, in Step P38, the rated electric current value of the offset printing section prime motor 142 is loaded from the memory M111.

Then, in Step P39, the electric current value of the offset printing section prime motor 142 is divided by the rated electric current value of the offset printing section prime motor 142 to compute the torque rate of the offset printing section prime motor 142, which is stored into the memory M112. Then, in Step P40, the torque distribution rate of the intaglio printing section auxiliary motor 148 is loaded from the memory M101.

Then, in Step P41, the torque rate of the offset printing section prime motor 142 is multiplied by the torque distribution rate of the intaglio printing section to compute the reference torque rate of the intaglio printing section auxiliary motor 148, which is stored into the memory M113. Then, in Step P42, the rated electric current value of the intaglio printing section auxiliary motor 148 is loaded from the memory M114.

Then, in Step P43, the reference torque rate of the intaglio printing section auxiliary motor 148 is multiplied by the rated electric current value of the intaglio printing section auxiliary motor 148 to compute the reference electric current value of the intaglio printing section auxiliary motor 148, which is stored into the memory M115. Then, in Step P44, the electric current value of the wiping roll drive motor 152 is loaded from the wiping roll drive motor driver 151, and stored into the memory M116.

Then, in Step P45, the reference electric current value of the wiping roll drive motor 152 is loaded from the memory M102. Then, in Step P46, the reference electric current value of the wiping roll drive motor 152 is subtracted from the electric current value of the wiping roll drive motor 152 to compute the difference in the electric current value of the wiping roll drive motor 152, which is stored into the memory M117.

Then, in Step P47, a table of conversion from the difference in the electric current value of the wiping roll drive motor to the correction value of the electric current value of the intaglio printing section auxiliary motor is loaded from the memory M118. Then, in Step P48, the correction value of the electric current value of the intaglio printing section auxiliary motor 148 is obtained from the difference in the electric current value of the wiping roll drive motor 152 with the use of the table of conversion from the difference in the electric current value of the wiping roll drive motor to the correction value of the electric current value of the intaglio printing section auxiliary motor, and this correction value is stored into the memory M119.

Then, in Step P49, the reference electric current value of the intaglio printing section auxiliary motor 148 is loaded from the memory M115. Then, in Step P50, the correction value of the electric current value of the intaglio printing section auxiliary motor 148 is added to or subtracted from the reference electric current value of the intaglio printing section auxiliary motor 148 to compute the electric current value (driving torque value) of the intaglio printing section auxiliary motor 148, which is stored into the memory M120.

Then, in Step P51, a torque control command and the electric current value (driving torque value) of the intaglio printing section auxiliary motor 148 are outputted to the intaglio printing section auxiliary motor driver 147, and the program returns to Step P15.

As a result of the above-described operational or action flow, the electric current value (driving torque value) of the intaglio printing section auxiliary motor 148 is controlled in accordance with the electric current value (torque value) for driving the offset printing section prime motor 142, and the electric current value (torque value) for driving the wiping roll drive motor 152.

Then, in Step P52 to which the program has shifted from the aforementioned Step P15, counting of the internal clock counter (for counting of the elapsed time) 119 is started. Then, in Step P53, the speed updating time interval is loaded from the memory M106.

Then, in Step P54, the count value of the internal clock counter 119 is loaded. Then, in Step P55, it is determined whether the count value of the internal clock counter is equal to the speed updating time interval. If the answer is Y, the previous command rotational speed is loaded from the memory M105 in Step P56. If the answer is N in Step P55, on the other hand, the program shifts to Step P72 to be described later.

Then, in Step P57, a rotational speed modification value during speed reduction is loaded from the memory M121. Then, in Step P58, the rotational speed modification value during speed reduction is subtracted from the previous command rotational speed to compute a modified current command rotational speed, which is stored into the memory M108.

Then, in Step P59, it is determined whether the modified current command rotational speed is equal to or less than zero. If the answer is Y, in Step P60, a stop command is outputted to the offset printing section prime motor driver 141. In Step P61, a stop command is outputted to the intaglio printing section auxiliary motor driver 147. Further, in Step P62, a stop command is outputted to the wiping roll drive motor driver 151. Then, the program returns to Step P1.

If the answer is N in Step P59, the memory M104 for storing the current command rotational speed is overwritten with the modified current command rotational speed in Step P63. Then, in Step P64, the current command rotational speed is loaded from the memory M104.

Then, in Step P65, the current command rotational speed of the wiping roll drive motor 152 is computed from the current command rotational speed, and stored into the memory M109. Then, in Step P66, the current command rotational speed is loaded from the memory M104.

Then, in Step P67, a speed control command and the current command rotational speed are outputted to the offset printing section prime motor driver 141. Then, in Step P68, the current command rotational speed of the wiping roll drive motor 152 is loaded from the memory M109.

Then, in Step P69, a speed control command and the current command rotational speed are outputted to the wiping roll drive motor driver 151. Then, in Step P70, the current command rotational speed is loaded from the memory M104. Then, in Step P71, the memory M105 for storing the previous command rotational speed is overwritten with the current command rotational speed, and the program returns to Step P52.

Then, in the aforementioned Step P72, the electric current value of the offset printing section prime motor 142 is loaded from the offset printing section prime motor driver 141, and stored into the memory M110. Then, in Step P73, the rated electric current value of the offset printing section prime motor 142 is loaded from the memory M111.

Then, in Step P74, the electric current value of the offset printing section prime motor 142 is divided by the rated electric current value of the offset printing section prime motor 142 to compute the torque rate of the offset printing section prime motor 142, which is stored into the memory M112. Then, in Step P75, the torque distribution rate of the intaglio printing section auxiliary motor 148 is loaded from the memory M101.

Then, in Step P76, the torque rate of the offset printing section prime motor 142 is multiplied by the torque distribution rate of the intaglio printing section to compute the reference torque rate of the intaglio printing section auxiliary motor 148, which is stored into the memory M113. Then, in Step P77, the rated electric current value of the intaglio printing section auxiliary motor 148 is loaded from the memory M114.

Then, in Step P78, the reference torque rate of the intaglio printing section auxiliary motor 148 is multiplied by the rated electric current value of the intaglio printing section auxiliary motor 148 to compute the reference electric current value of the intaglio printing section auxiliary motor 148, which is stored into the memory M115. Then, in Step P79, the electric current value of the wiping roll drive motor 152 is loaded from the wiping roll drive motor driver 151, and stored into the memory M116.

Then, in Step P80, the reference electric current value of the wiping roll drive motor 152 is loaded from the memory M102. Then, in Step P81, the reference electric current value of the wiping roll drive motor 152 is subtracted from the electric current value of the wiping roll drive motor 152 to compute the difference in the electric current value of the wiping roll drive motor 152, which is stored into the memory M117.

Then, in Step P82, a table of conversion from the difference in the electric current value of the wiping roll drive motor to the correction value of the electric current value of the intaglio printing section auxiliary motor is loaded from the memory M118. Then, in Step P83, the correction value of the electric current value of the intaglio printing section auxiliary motor 148 is obtained from the difference in the electric current value of the wiping roll drive motor 152 with the use of the table of conversion from the difference in the electric current value of the wiping roll drive motor to the correction value of the electric current value of the intaglio printing section auxiliary motor, and this correction value is stored into the memory M119.

Then, in Step P84, the reference electric current value of the intaglio printing section auxiliary motor 148 is loaded from the memory M115. Then, in Step P85, the correction value of the electric current value of the intaglio printing section auxiliary motor 148 is added to or subtracted from the reference electric current value of the intaglio printing section auxiliary motor 148 to compute the electric current value (driving torque value) of the intaglio printing section auxiliary motor 148, which is stored into the memory M120.

Then, in Step P86, a torque control command and the electric current value (driving torque value) of the intaglio printing section auxiliary motor 148 are outputted to the intaglio printing section auxiliary motor driver 147, and the program returns to Step P53.

In accordance with the above-described operational or action flow, even during speed reduction of the sheet-fed printing press 10, speed switching control, and driving torque control of the intaglio printing section auxiliary motor 148, which are similar to those at constant speed or during speed acceleration, are exercised.

Then, in Step P87 to which the program has shifted from the aforementioned Step P7, it is determined whether a set rotational speed has been inputted to the rotational speed setting unit 132 for offset printing section independent drive. If the answer is Y, in Step P88, the rotational speed for offset printing section independent drive is loaded from the rotational speed setting unit 132 for offset printing section independent drive, and stored into the memory M122. Then, the program shifts to Step P89. If the answer is N in Step P87, the program directly shifts to Step P89.

Then, in Step P89, it is determined whether a set rotational speed has been inputted to the rotational speed setting unit 133 for intaglio printing section independent drive. If the answer is Y, in Step P90, the rotational speed for intaglio printing section independent drive is loaded from the rotational speed setting unit 133 for intaglio printing section independent drive, and stored into the memory M123. Then, the program shifts to Step P91. If the answer is N in Step P89, the program directly shifts to Step P91.

Then, in Step P91, it is determined whether a set rotational speed has been inputted to the rotational speed setting unit 134 for wiping roll independent drive. If the answer is Y, in Step P92, the rotational speed for wiping roll independent drive is loaded from the rotational speed setting unit 134 for wiping roll independent drive, and stored into the memory M124. Then, the program shifts to Step P93. If the answer is N in Step P91, the program directly shifts to Step P93.

Then, in Step P93, it is determined whether the offset printing section independent drive switch 122 has been turned on. If the answer is Y, a connection release signal is outputted to the printing section connecting clutch 156 in Step P94. If the answer is N, the program shifts to Step P97 to be described later.

Then, in Step P95, the rotational speed for offset printing section independent drive is loaded from the memory M122. Then, in Step P96, the speed control command and the rotational speed for offset printing section independent drive are outputted to the offset printing section prime motor driver 141.

Then, in the above-mentioned Step P97, it is determined whether the intaglio printing section independent drive switch 124 has been turned on. If the answer is Y, a connection release signal is outputted to the printing section connecting clutch 156 in Step P98. If the answer is N in Step P97, the program shifts to Step P101 to be described later.

Then, in Step P99, the rotational speed for intaglio printing section independent drive is loaded from the memory M123. Then, in Step P100, a speed control command and the rotational speed for intaglio printing section independent drive are outputted to the intaglio printing section auxiliary motor driver 147.

Then, in the above-mentioned Step P101, it is determined whether the wiping roll independent drive switch 126 has been turned on. If the answer is Y, the rotational speed for wiping roll independent drive is loaded from the memory M124 in Step P102. Then, the program shifts to Step P103. If the answer is N in Step P103, the program shifts to Step P104 to be described later.

Then, in Step P103, a speed control command and the rotational speed for wiping roll independent drive are outputted to the wiping roll drive motor driver 151. Then, in the above Step P104, it is determined whether the offset printing section independent drive stop switch 123 has been turned on.

If the answer is Y in the above Step P104, a stop command is outputted to the offset printing section prime motor driver 141 in Step P105. Then, the program shifts to Step P106. If the answer is Y in Step P104, the program shifts directly to Step P106.

Then, in the above Step P106, it is determined whether the intaglio printing section independent drive stop switch 125 has been turned on. If the answer is Y, a stop command is outputted to the intaglio printing section auxiliary motor driver 147 in Step P107. Then, the program shifts to Step P108. If the answer is N in Step P106, the program shifts directly to Step P108.

Then, in Step P108, it is determined whether the wiping roll independent drive stop switch 127 has been turned on. If the answer is Y, a stop command is outputted to the wiping roll drive motor driver 151 in Step P109. Then, the program shifts to Step P110. If the answer is N in Step P108, the program shifts directly to Step P110.

Then, in the above Step P110, it is determined whether stop commands are being outputted to the offset printing section prime motor driver 141, the intaglio printing section auxiliary motor driver 147, and the wiping roll drive motor driver 151. If the answer is Y, the program returns to Step P1. If the answer is N, the program returns to Step P87.

In accordance with the above-described operational or action flow, the offset printing section prime motor 142, the intaglio printing section auxiliary motor 148, and the wiping roll drive motor 152 are individually controlled to be rotationally driven, whereby the independent drive of each printing section is carried out. The speed control command issued to each motor driver in the above embodiment refers to a command to control each motor so as to be driven at the outputted rotational speed. The torque control command issued to each motor driver refers to a command to control each motor to be driven with the outputted torque.

In the present embodiment, as described above, the offset printing section 20 and the intaglio printing section 30 are coupled together by the gear train. Separately from the offset printing section prime motor 142 for driving the entire sheet-fed printing press 10, the intaglio printing section auxiliary motor 148 is provided in the intaglio printing section 30 where the load is heaviest and load variations are great. By so doing, the sheet-fed printing press 10 as a whole is driven by the offset printing section prime motor 142 and the intaglio printing section auxiliary motor 148. Moreover, the driving torque of the intaglio printing section auxiliary motor 148 is obtained from the driving torques of the offset printing section prime motor 142 and the wiping roll drive motor 153.

Because of these features, the driving torque of the intaglio printing section auxiliary motor 148 during printing can be automatically set appropriately according to load variations of the intaglio printing section 30. Thus, the low capacity of the offset printing section prime motor 142 can be achieved. As a result, the drive system of the sheet-fed printing press 10 can be downsized to make cost reduction and high speed printing possible.

With the connection by the printing section connecting clutch 156 being released, the offset printing section 20 and the intaglio printing section 30 can be independently driven by the offset printing section prime motor 142 and the intaglio printing section auxiliary motor 148, respectively. In the respective printing sections 20 and 30, therefore, printing preparation operations such as blanket washing and inker washing can be performed individually. On this occasion, gripper release mechanisms (see the aforementioned annular groove 50 and the dimension L) for the many grippers 47*a*, 49*a* in the aforementioned gripper devices 47, 49 provided between the last transfer cylinder 23*e* of the offset printing section 20 and the first transfer cylinder 23*f* of the intaglio printing section 30 enable the offset printing section 20 and the intaglio printing section 30 to be independently driven without hindrance.

It goes without saying that the present invention is not limited to the above embodiments, and various changes and modifications may be made without departing from the gist of the present invention.

INDUSTRIAL APPLICABILITY

The present invention can be applied to a drive control method and a drive control apparatus for a printing press such as a sheet-fed printing press.

REFERENCE SIGNS LIST

4A Belt
4B Worm gear mechanism
10 Sheet-fed printing press
20 Offset printing section
20*a* to 20*d* Offset face-side printing units for first to fourth colors
20*e* to 20*h* Offset back-side printing units for first to fourth colors
20*i* Face-side drying unit
20*j* Back-side drying unit
20*k* Rotary screen printing unit
201 Drying unit
21*a* to 21*i* Impression cylinders
22*a* to 22*c* Drying cylinders
23*a* to 23*f* Transfer cylinders
30 Intaglio printing section
31 Impression cylinder
32 Intaglio cylinder
34 Wiping device
34*a* Wiping roll
141 Offset printing section prime motor driver
142 Offset printing section prime motor
143 Rotary encoder for offset printing section prime motor
147 Intaglio printing section auxiliary motor driver
148 Intaglio printing section auxiliary motor
149 Rotary encoder for intaglio printing section auxiliary motor
151 Wiping roll drive motor driver
152 Wiping roll drive motor
153 Rotary encoder for wiping roll drive motor
156 Printing section connecting clutch
157 Connection detector for printing section connecting clutch
200 Drive controller for offset printing section and intaglio printing section

The invention claimed is:

1. A drive control method for a printing press which includes
an offset printing section for doing offset printing,
an intaglio printing section for doing intaglio printing,
a gear train for drivingly connecting the offset printing section and the intaglio printing section, and
a prime motor for driving the offset printing section and the intaglio printing section,
the drive control method comprising:
providing an auxiliary motor in the intaglio printing section;
driving, by means of the prime motor, the offset printing section and the intaglio printing section drivingly connected to the gear train; and
driving the intaglio printing section, by means of the auxiliary motor, in accordance with a torque value for driving the prime motor.

2. The drive control method for a printing press according to claim 1, further comprising:
further providing a wiping roll motor for driving a wiping roll of the intaglio printing section; and
driving the auxiliary motor in accordance with the torque value for driving the prime motor, and a torque value for driving the wiping roll motor.

3. The drive control method for a printing press according to claim 1, further comprising:
obtaining a driving torque value of the auxiliary motor from a torque for driving the prime motor, a torque distribution rate of the auxiliary motor, and a rated electric current value of the auxiliary motor.

4. The drive control method for a printing press according to claim 1, further comprising:
further providing a wiping roll motor for driving a wiping roll of the intaglio printing section, and an electric current value display unit for displaying a driving torque value of the wiping roll motor; and
adjusting a torque of the auxiliary motor in accordance with an electric current value of the electric current value display unit.

5. The drive control method for a printing press according to claim 1, further comprising:
providing a first transfer cylinder equipped with a first holding portion for passing a printing product printed by the offset printing section on to the intaglio printing section, a second transfer cylinder equipped with a second holding portion for receiving the printing product printed by the offset printing section from the offset printing section, a clutch for bringing a gear train between the first transfer cylinder and the second transfer cylinder into a connected state and a connection-released state, and a gripper release mechanism for keeping the second holding portion or the first holding portion out of contact with the first transfer cylinder or the second transfer cylinder; and driving the prime motor and the auxiliary motor independently of each other.

6. A drive control apparatus for a printing press, comprising:

an offset printing section for doing offset printing:

an intaglio printing section for doing intaglio printing;

a gear train for drivingly connecting the offset printing section and the intaglio printing section;

a prime motor for driving the offset printing section and the intaglio printing section;

an auxiliary motor provided in the intaglio printing section; and a controller, driving, by means of the prime motor, the offset printing section and the intaglio printing section drivingly connected to the gear train; and driving the intaglio printing section, by means of the auxiliary motor, in accordance with a torque value for driving the prime motor.

7. The drive control apparatus for a printing press according to claim 6, further comprising:

a wiping roll motor for driving a wiping roll of the intaglio printing section, and wherein the controller drives the auxiliary motor in accordance with the torque value for driving the prime motor, and a torque value for driving the wiping roll motor.

8. The drive control apparatus for a printing press according to claim 6, wherein the controller obtains a driving torque value of the auxiliary motor from a torque for driving the prime motor, a torque distribution rate of the auxiliary motor, and a rated electric current value of the auxiliary motor.

9. The drive control apparatus for a printing press according to claim 6, further comprising:

a wiping roll motor for driving a wiping roll of the intaglio printing section, and an electric current value display unit for displaying a driving torque value of the wiping roll motor.

10. The drive control apparatus for a printing press according to claim 6, further comprising:

a first transfer cylinder equipped with a first holding portion for passing a printing product printed by the offset printing section on to the intaglio printing section, a second transfer cylinder equipped with a second holding portion for receiving the printing product printed by the offset printing section from the offset printing section, a clutch for bringing a gear train between the first transfer cylinder and the second transfer cylinder into a connected state and a connection-released state, and a gripper release mechanism for keeping the second holding portion or the first holding portion out of contact with the first transfer cylinder or the second transfer cylinder, and wherein the controller controls the prime motor and the auxiliary motor so as to be driven independently of each other.

* * * * *